US008627904B2

(12) United States Patent
Voronin

(10) Patent No.: US 8,627,904 B2
(45) Date of Patent: Jan. 14, 2014

(54) THERMALLY STABLE POLYCRYSTALLINE DIAMOND MATERIAL WITH GRADIENT STRUCTURE

(75) Inventor: Georgiy Voronin, Orem, UT (US)

(73) Assignee: Smith International, Inc., Houston, TX (US)

( * ) Notice: Subject to any disclaimer, the term of this patent is extended or adjusted under 35 U.S.C. 154(b) by 471 days.

(21) Appl. No.: 12/753,642

(22) Filed: Apr. 2, 2010

(65) Prior Publication Data

US 2010/0236836 A1 Sep. 23, 2010

Related U.S. Application Data

(63) Continuation-in-part of application No. 11/867,629, filed on Oct. 4, 2007, now Pat. No. 7,980,334.

(51) Int. Cl.
*E21B 10/36* (2006.01)

(52) U.S. Cl.
USPC ..... 175/428; 175/420.2

(58) Field of Classification Search
USPC ..... 175/420.2, 425, 426, 428, 433, 434; 75/312
See application file for complete search history.

(56) References Cited

U.S. PATENT DOCUMENTS

| | | | |
|---|---|---|---|
| 3,136,615 | A | 6/1964 | Bovenkerk et al. |
| 4,151,686 | A | 5/1979 | Lee et al. |
| 4,255,165 | A | 3/1981 | Dennis et al. |
| 4,268,276 | A | 5/1981 | Bovenkerk |
| 4,303,442 | A | 12/1981 | Hara et al. |
| 4,412,980 | A | 11/1983 | Tsuji et al. |
| 4,534,773 | A | 8/1985 | Phaal et al. |
| 4,556,403 | A | 12/1985 | Almond et al. |
| 4,604,106 | A | 8/1986 | Hall |
| 4,606,738 | A | 8/1986 | Hayden |
| 4,636,253 | A | 1/1987 | Nakai et al. |
| 4,664,705 | A | 5/1987 | Horton et al. |

(Continued)

FOREIGN PATENT DOCUMENTS

| | | | |
|---|---|---|---|
| CA | 2639727 | A1 | 4/2009 |
| EP | 0196777 | A1 | 10/1986 |

(Continued)

OTHER PUBLICATIONS

Office Action issued in corresponding United Kingdom Application No. GB1105652.0 dated Jul. 28, 2011 (7 pages).

(Continued)

*Primary Examiner* — Cathleen Hutchins
(74) *Attorney, Agent, or Firm* — Osha Liang LLP

(57) ABSTRACT

A diamond construction may include a diamond body comprising a plurality of bonded-together diamond crystals forming a matrix phase, and a plurality of interstitial regions disposed between the bonded-together diamond crystals, the diamond body comprising: a first diamond region extending a depth from a surface of the diamond body being substantially free of a catalyst material used to form the diamond body, wherein the first diamond region comprises the matrix phase and in at least a portion of the plurality of interstitial spaces, the first diamond region comprises a metal carbide and an inert metal, wherein the metal carbide is formed as a result of reaction between the diamond crystals in the matrix phase and a carbide-forming metal; and a second diamond region adjacent the first diamond region comprising the matrix phase and a Group VIII metal in the interstitial regions.

19 Claims, 8 Drawing Sheets

(56) References Cited

U.S. PATENT DOCUMENTS

| | | | |
|---|---|---|---|
| 4,707,384 | A | 11/1987 | Schachner et al. |
| 4,766,040 | A | 8/1988 | Hillert et al. |
| 4,793,828 | A | 12/1988 | Burnand |
| 4,798,026 | A | 1/1989 | Cerceau |
| 4,861,350 | A | 8/1989 | Phaal et al. |
| 4,871,377 | A | 10/1989 | Frushour |
| 4,875,907 | A | 10/1989 | Phaal et al. |
| 4,899,922 | A | 2/1990 | Slutz et al. |
| 4,940,180 | A | 7/1990 | Martell |
| 4,943,488 | A | 7/1990 | Sung et al. |
| 4,944,772 | A | 7/1990 | Cho |
| 4,976,324 | A | 12/1990 | Tibbitts |
| 4,985,051 | A | 1/1991 | Ringwood |
| 5,011,514 | A | 4/1991 | Cho et al. |
| 5,027,912 | A | 7/1991 | Juergens |
| 5,030,276 | A | 7/1991 | Sung et al. |
| 5,032,147 | A | 7/1991 | Frushour |
| 5,037,704 | A | 8/1991 | Nakai et al. |
| 5,127,923 | A | 7/1992 | Bunting et al. |
| 5,370,195 | A | 12/1994 | Keshavan et al. |
| 5,560,716 | A | 10/1996 | Tank et al. |
| 5,620,382 | A | 4/1997 | Cho et al. |
| 5,875,862 | A | 3/1999 | Jurewicz et al. |
| 5,897,942 | A | 4/1999 | Karner et al. |
| 6,009,963 | A | 1/2000 | Chaves et al. |
| 6,193,001 | B1 | 2/2001 | Eyre et al. |
| 6,248,447 | B1 | 6/2001 | Griffin et al. |
| 6,269,894 | B1 | 8/2001 | Griffin |
| 6,302,225 | B1 | 10/2001 | Yoshida et al. |
| 6,344,149 | B1 | 2/2002 | Oles |
| 6,410,085 | B1 | 6/2002 | Griffin et al. |
| 6,435,058 | B1 | 8/2002 | Matthias et al. |
| 6,443,248 | B2 | 9/2002 | Yong et al. |
| 6,544,308 | B2 | 4/2003 | Griffin et al. |
| 6,562,462 | B2 | 5/2003 | Griffin et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,739,214 | B2 | 5/2004 | Griffin et al. |
| 7,377,341 | B2 | 5/2008 | Middlemiss et al. |
| 7,462,003 | B2 | 12/2008 | Middlemiss |
| 7,647,993 | B2 | 1/2010 | Middlemiss |
| 2002/0074168 | A1 | 6/2002 | Matthias et al. |
| 2005/0050801 | A1 | 3/2005 | Cho et al. |
| 2005/0129950 | A1 | 6/2005 | Griffin et al. |
| 2005/0230156 | A1 | 10/2005 | Belnap et al. |
| 2005/0263328 | A1 | 12/2005 | Middlemiss |
| 2006/0165993 | A1 | 7/2006 | Keshavan |
| 2006/0191723 | A1 | 8/2006 | Keshavan |
| 2006/0217258 | A1 | 9/2006 | Zhao |
| 2007/0079994 | A1* | 4/2007 | Middlemiss ..... 175/426 |
| 2007/0151769 | A1 | 7/2007 | Slutz et al. |
| 2007/0187155 | A1 | 8/2007 | Middlemiss |
| 2008/0073126 | A1 | 3/2008 | Shen et al. |
| 2008/0185189 | A1 | 8/2008 | Griffo et al. |
| 2008/0223621 | A1 | 9/2008 | Middlemiss et al. |
| 2008/0230280 | A1 | 9/2008 | Keshavan et al. |
| 2009/0090563 | A1 | 4/2009 | Voronin et al. |
| 2009/0152017 | A1 | 6/2009 | Shen et al. |

FOREIGN PATENT DOCUMENTS

| | | | |
|---|---|---|---|
| EP | 0297071 | A1 | 12/1988 |
| EP | 0329954 | A2 | 8/1989 |
| EP | 0352811 | A1 | 1/1990 |
| EP | 0374424 | A1 | 6/1990 |
| EP | 0612868 | A1 | 8/1994 |
| EP | 0617207 | A2 | 9/1994 |
| EP | 1116858 | A1 | 7/2001 |
| EP | 1190791 | A2 | 3/2002 |
| EP | 1760165 | A2 | 3/2007 |
| GB | 1349385 | A | 4/1974 |
| GB | 2270493 | A | 3/1994 |
| GB | 2408735 | A | 6/2005 |
| GB | 2413813 | A | 11/2005 |
| GB | 2427215 | A | 12/2006 |
| GB | 2431948 | A | 5/2007 |
| GB | 2453023 | A | 3/2009 |
| GB | 2453435 | A | 4/2009 |
| JP | 8176696 | A | 7/1996 |
| RU | 2034937 | C1 | 5/1995 |
| WO | 9323204 | A1 | 11/1993 |
| WO | 9929465 | A1 | 6/1999 |
| WO | 0028106 | A1 | 5/2000 |
| WO | 2007042920 | A1 | 4/2007 |

OTHER PUBLICATIONS

Examination Report issued in corresponding United Kingdom Application No. GB1105652.0 dated Jul. 4, 2012 (3 pages).

Combined Search and Examination Report issued in corresponding United Kingdom Application No. GB1209894.3 dated Jul. 4, 2012 (6 pages).

Examination Report issued in corresponding UK Application No. 1105652.0 dated Feb. 7, 2013 (2 pages).

Examination Report issued in corresponding UK Application No. 1209894.3 dated Feb. 7, 2013 (2 pages).

* cited by examiner

THERMALLY STABLE POLYCRYSTALLINE DIAMOND MATERIAL WITH GRADIENT STRUCTURE

CROSS-REFERENCE TO RELATED APPLICATIONS

This application is a continuation-in-part of U.S. patent application Ser. No. 11/867,629, filed on Oct. 4, 2007, which is herein incorporated by reference in its entirety.

BACKGROUND OF INVENTION

1. Field of the Invention

Embodiments disclosed herein relate generally to diamond constructions and, more specifically, to polycrystalline diamond-containing constructions and compacts formed therefrom that are specially engineered to provide improved thermal and mechanical properties when compared to conventional polycrystalline diamond materials.

2. Background Art

Polycrystalline diamond (PCD) materials and PCD elements formed therefrom are well known in the art. Conventional PCD is formed subjecting diamond grains in the presence of a suitable solvent catalyst material to processing conditions of extremely high pressure/high temperature (HPHT), where the solvent catalyst material promotes desired intercrystalline diamond-to-diamond bonding between the grains, thereby forming a PCD structure. The resulting PCD structure produces enhanced properties of wear resistance and hardness, making such PCD materials extremely useful in aggressive wear and cutting applications where high levels of wear resistance and hardness are desired.

Solvent catalyst materials typically used for forming conventional PCD include metals from Group VIII of the Periodic table, with Cobalt (Co) being the most common. Conventional PCD can comprise from 85 to 95% by volume diamond and a remaining amount of the solvent catalyst material. The solvent catalyst material is present in the microstructure of the PCD material within interstitial regions that exist between the bonded-together diamond grains.

A problem known to exist with such conventional PCD is thermal degradation due to differential thermal expansion characteristics between the interstitial solvent catalyst material used to sinter the PCD and the intercrystalline bonded diamond. Such differential thermal expansion is known to occur at temperatures of about 400° C., causing ruptures to occur in the diamond-to-diamond bonding, and resulting in the formation of cracks and chips in the PCD structure.

Another problem known to exist with conventional PCD materials is also related to the presence of the solvent catalyst material used to sinter the PCD in the interstitial regions and the adherence of the solvent catalyst to the diamond crystals to cause another form of thermal degradation. Specifically, the solvent catalyst material is known to cause an undesired catalyzed phase transformation in diamond (converting it to carbon monoxide, carbon dioxide, or graphite) with increasing temperature, thereby limiting practical use of conventional PCD to about 750° C.

Attempts at addressing such unwanted forms of thermal degradation in PCD are known in the art. Generally, these attempts have involved forming a PCD body having an improved degree of thermal stability when compared to those conventional PCD materials discussed above. One known technique of producing a thermally stable PCD body involves at least a two-stage process of first forming a conventional sintered PCD body in the manner described above, and then removing the solvent catalyst material therefrom.

This method produces a diamond body that is substantially free of the solvent catalyst material, and is therefore promoted as providing a diamond body having improved thermal stability when compared to conventional PCD. However, the resulting thermally stable diamond body typically does not include a metallic substrate attached thereto, by solvent catalyst infiltration from such substrate due to the solvent catalyst removal process, as all of the solvent catalyst material has been removed therefrom.

Also, the resulting diamond body has a material microstructure comprising a matrix phase of bonded-together diamond grains, and a plurality of open interstitial regions, pores or voids distributed throughout the diamond body. The presence of such population of open voids throughout the diamond body adversely impacts desired mechanical properties of the diamond body, e.g., provides a diamond body having reduced properties of strength and toughness when compared to conventional PCD. It is theorized that the presence of the catalyst material within the voids in conventional PCD operates to place the surrounding diamond matrix in a state of compression that operates to provide improved mechanical strength, e.g., fracture toughness and/or impact strength, to the PCD. Removing the catalyst material from the diamond body is thus believed to remove the diamond from a compression state, thereby also reducing the above-noted related mechanical properties of the diamond body.

Thus, thermally stable diamond bodies made by removing the solvent catalyst material therefrom are known to be relatively brittle and have poor properties of strength and/or toughness, thereby limiting their use to less extreme or severe applications. This feature makes such conventional thermally stable diamond bodies generally unsuited for use in aggressive cutting and/or wear applications, such as use as a cutting element of a subterranean drilling and the like.

The resulting diamond body, rendered free of the solvent catalyst material, has a coefficient of thermal expansion that is sufficiently different from that of conventional substrate materials (such as WC—Co and the like) typically infiltrated or otherwise attached to conventional PCD bodies to provide a diamond compact to adopt the diamond body construction for use with desirable wear and/or cutting end use devices. This difference in thermal expansion between the now thermally stable diamond body and the substrate, combined with the poor wettability of the diamond body surface due to the removal of the solvent catalyst material, makes it very difficult to form an adequate attachment between the diamond body and conventionally used substrates, thereby requiring that the diamond body itself be attached or mounted directly to the wear and/or cutting device.

However, since such thermally stable diamond body is devoid of a metallic substrate, it cannot (e.g., when configured for use as a cutting element in a bit used for subterranean drilling) be attached to such drill bit by conventional brazing process. Thus, use of such thermally stable diamond body in this particular application necessitates that the diamond body itself be attached to the drill bit by mechanical or interference fit during manufacturing of the drill bit, which is labor intensive, time consuming, and which does not provide a most secure method of attachment.

Other attempts that have been made to improve the thermal stability of PCD materials include where the solvent metal catalyst material used to form the PCD is removed from only a region of the body, i.e., where the solvent metal catalyst is removed from a defined region of the diamond body that extends a depth from the body surface. Such diamond body constructions are formed by starting with conventional PCD, and then selectively removing the solvent metal catalyst from only a region of the body extending a depth from the body surface, wherein a remaining portion of the diamond body comprises conventional PCD. While this approach has demonstrated some improvement in thermal stability over conventional PCD, the resulting diamond body still suffers from the problems noted above. Namely, that the treated region rendered devoid of the catalyst material has reduced mechanical properties of strength and/or toughness when compared to conventional PCD, due to the absence of the catalyst material and the related presence of the plurality of empty pores or voids in the interstitial regions.

It is, therefore, desired that a diamond construction be developed having improved thermal characteristics and thermal stability when compared to conventional PCD materials. It is also desired that such diamond construction be engineered to include a suitable substrate to form a compact construction that can be attached to a desired wear and/or cutting device by conventional method such as welding or brazing and the like. It is further desired that such diamond construction display desired mechanical properties such as strength and toughness when compared to conventional thermally stable diamond bodies, i.e., characterized by having a plurality of empty interstitial regions formed by removing the catalyst material therefrom.

SUMMARY OF INVENTION

In one aspect, embodiments disclosed herein relate to a diamond construction that includes a diamond body comprising a plurality of bonded-together diamond crystals forming a matrix phase, and a plurality of interstitial regions disposed between the bonded-together diamond crystals, the diamond body comprising: a first diamond region extending a depth from a surface of the diamond body being substantially free of a catalyst material used to form the diamond body, wherein the first diamond region comprises the matrix phase and in at least a portion of the plurality of interstitial spaces, the first diamond region comprises a metal carbide and an inert metal, wherein the metal carbide is formed as a result of reaction between the diamond crystals in the matrix phase and a carbide-forming metal; and a second diamond region adjacent the first diamond region comprising the matrix phase and a Group VIII metal in the interstitial regions.

In another aspect, embodiments disclosed herein relate to a drill bit that includes a body; and a plurality of cutting elements attached thereto, wherein at least one of the cutting elements comprise a diamond construction that may include a diamond body comprising a plurality of bonded-together diamond crystals forming a matrix phase, and a plurality of interstitial regions disposed between the bonded-together diamond crystals, the diamond body comprising: a first diamond region extending a depth from a surface of the diamond body being substantially free of a catalyst material used to form the diamond body, wherein the first diamond region comprises the matrix phase and in at least a portion of the plurality of interstitial spaces, the first diamond region comprises a metal carbide and an inert metal, wherein the metal carbide is formed as a result of reaction between the diamond crystals in the matrix phase and a carbide-forming metal; and a second diamond region adjacent the first diamond region comprising the matrix phase and a Group VIII metal in the interstitial regions.

In yet another aspect, embodiments disclosed herein relate to a method for making a diamond construction that includes treating a diamond body having a material microstructure comprising a matrix phase of bonded-together diamond grains and interstitial regions disposed between the diamond grains, wherein a catalyst material used to form the diamond body during a first high pressure/high temperature condition is disposed within the interstitial regions, wherein during the step of treating, the catalyst material is removed from interstitial regions of the diamond body; placing an infiltrant material next to the diamond body depleted of the catalyst material, wherein the infiltrant material comprises an alloy having at least two metals, one of the two metals being a carbide-forming metal, and the other of the two metals being an inert metal; and subjecting the diamond body to second high pressure/high temperature condition in order to allow an alloy to infiltrate into interstitial regions and to form a metal carbide between the carbide-forming metal in the infiltrant material and the diamond grains within the interstitial regions at least adjacent to a surface of the diamond body.

Other aspects and advantages of the invention will be apparent from the following description and the appended claims.

DETAILED DESCRIPTION

Figure 1:
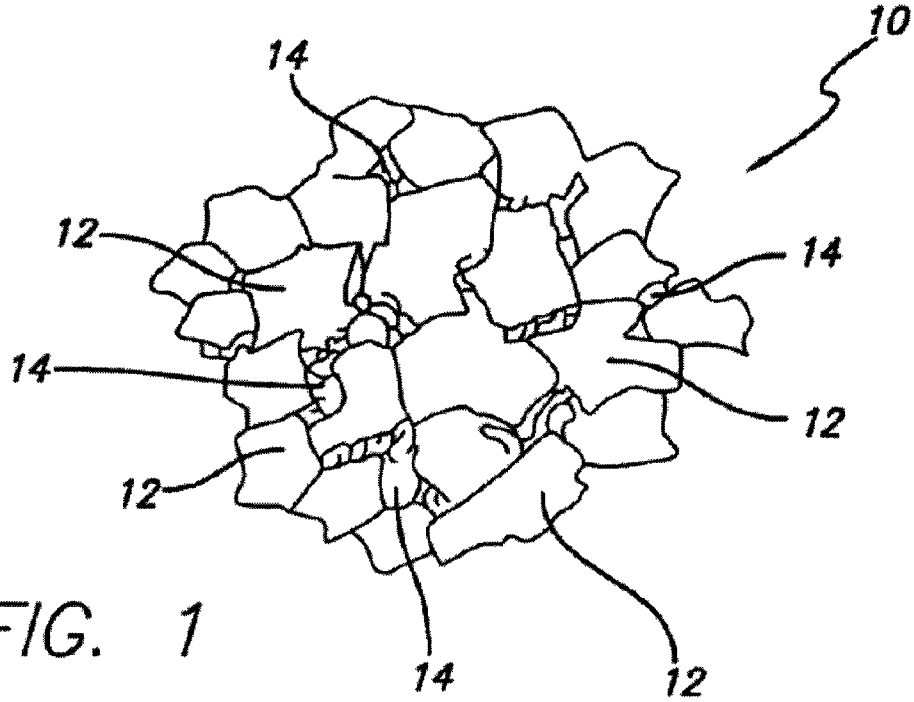
FIG. 1 is schematic microstructural view taken of a thermally stable region of a diamond construction of this invention.

Polycrystalline diamond (PCD) constructions of the present disclosure may include a diamond body (of diamond particles bonded together) that possesses a gradient structure. Specifically, the diamond body may possess at least two regions therein, a first region (thermally stable region) that extends from at least a portion of an upper surface into the diamond body and a second region that extends upwards into the diamond body from the surface opposing the upper surface (i.e., from a substrate). The first, thermally stable region may have a material microstructure having a matrix first phase of bonded-together diamond crystals, and a plurality of second phases interposed within the matrix first phase. The plurality of second phases in the first region may include a material that is a reaction product formed between a reactive, carbide-forming material and the diamond crystals at high pressure/high temperature (HPHT) conditions to form a metal carbide, as well as an inert metal component. However, the plurality of second phases within the first, thermally stable region are not necessarily all identical in nature. Rather, embodiments of the present disclosure may provide for a gradient of compositional makeup for the plurality of second phases through the first, thermally stable region. In an example embodiment, the plurality of second phases occupy voids that previously existed within the interstitial regions of the material microstructure and that were formed by removing a catalyst material therefrom. The second phase may or may not occupy all of the voids in the thermally stable region.

The second region of the diamond body may include a material microstructure having a matrix first phase of bonded-together diamond crystals and a plurality of second phases interposed within the matrix first phase, where the second phase is occupied by one or more Group VIII metals. Further, one skilled in the art, upon reading the teachings contained in the present disclosure, should also appreciated that there may be some gradual transition between the first region and the second region, and that there may not necessarily be a clear demarcation between the two regions (in their second phases).

In an example embodiment, the thermally stable region is substantially free of the solvent catalyst material that was used to initially sinter the diamond grains together during a first HPHT process to form the diamond body. Further, the metal carbide and/or inert metal used to fill the voids and the diamond grains may have one or more thermal characteristics that more closely match the bonded-together diamond crystals then those of the catalyst material that was removed from the thermally stable region. Additionally, it may be desirable that the metal carbide and/or inert metal operate to elevate the graphitization temperature of the thermally-stable region when compared to the graphitization temperature of such region as previously occupied with the catalyst material.

In an example embodiment, the thermally stable region is formed by first removing the catalyst material used to form the diamond body therefrom, and then filling all or a portion of the resulting empty voids or pores through the use of an infiltrant material that infiltrates into pores previously occupied by the catalyst material. In accordance with embodiments of the present disclosure, the infiltrant material may be an alloy of two or more metals, one metal being selected from a first metal type that is inert/nonreactive to diamond (at the infiltration conditions) and a second metal being selected from a second metal type that is a reactive, carbide-former. The inert metal component in the infiltrant alloy may help provide for the desired infiltration of the reactive carbide-former, and/or help reduce the melting temperature of the reactive material to facilitate infiltration at a desired temperature, and/or help control the rate of reaction between the carbide-former metal and the diamond crystals (i.e., to form a metal carbide). Further, as a molten infiltrant alloy penetrates into a diamond body, the carbide-former metal may react with the diamond crystals, causing formation of metal carbide particles along the surfaces of the diamond crystals and gradual depletion in the amount of carbide-forming metal present in the molten infiltrant as it penetrated deeper into the diamond body. The plurality of second phases (between the interbonded diamond crystals) may thus include the formed metal carbide, as well as the inert metal. However, as the molten infiltrant penetrates to deeper depths, the relative amount of metal carbide within those second phases decreases as the relative amount of inert metal within those second phases increases. Thus, in this manner, a gradient structure within the thermally stable region of the diamond body is formed.

As used herein, the term "PCD" is used to refer to polycrystalline diamond that has been formed, at high pressure/high temperature (HPHT) conditions, through the use of a metal solvent catalyst, such as those metals included in Group VIII of the Periodic table, that remains within the material microstructure. However, the diamond regions of the present disclosure having the presently described infiltrant material therein are not referred to as being PCD because they do not include the catalyst material that was used to initially sinter the diamond body. Further, these regions are also unlike conventional thermally stable diamond materials because they do not include a plurality of unfilled interstitial voids or pores resulting from the removal of the catalyst material therefrom.

However, in accordance with various embodiments of the present disclosure, the diamond bodies or constructions described herein may include a region substantially free of the catalyst material (and filled with an infiltrant material), a region of conventional PCD that includes the catalyst material that was used to sinter the diamond body, and an optional layer or region of material disposed over a surface of the diamond region substantially free of the catalyst material. In other embodiments, the diamond bodies or constructions may include a region substantially free of the catalyst material (and filled with an infiltrant material), a region of conventionally diamond crystals and a Group VIII metal from the Periodic table that was not used to sinter the diamond body, and an optional layer or region of material disposed over a surface of the diamond region substantially free of the catalyst material.

The presence of the PCD region or diamond region including the Group VIII metal that was not used to sinter the diamond body, and/or the layer of material disposed over the diamond region substantially free of the catalyst material may assist in imparting desired properties of hardness/toughness and impact strength to the diamond body that are otherwise lacking in conventional thermally stable diamond materials that have been rendered thermally stable by having substantially all of the solvent catalyst material removed therefrom and not replaced. The presence such a PCD region, or diamond region including the Group VIII metal not used to sinter the diamond body, in the diamond body may also allow diamond constructions of this disclosure to be permanently joined to a desired substrate, thereby facilitating attachment of the resulting diamond compact to a desired end use cutting and/or wear and/or machining device, e.g., a bit used for drilling subterranean formations, by conventional means such as by brazing, welding and the like.

In an example embodiment, diamond constructions of the present disclosure may be made by treating a PCD body or compact to remove at least a portion of the catalyst material that was used to sinter the same during HPHT processing from a region thereof, and then filling at least a portion of the region removed of the catalyst material with a infiltrant material, such as those briefly mentioned above and described in more details below. When starting with a preformed PCD compact, the diamond constructions of the present disclosure may be formed using a single HPHT process, and when starting without a preformed PCD compact, the diamond constructions of the present disclosure may be formed using two HPHT processes; namely, a first HPHT process to form the PCD compact, and a second HPHT process to form the desired diamond construction.

FIG. 1 illustrates a region of a diamond construction 10 of this disclosure that is substantially free of the catalyst material that was used to initially sinter the diamond body, and that has a resulting material microstructure comprising a polycrystalline diamond matrix first phase 12 including a plurality of bonded-together diamond crystals formed at HPHT conditions. A plurality of second phases 14 are disposed interstitially between the bonded together diamond crystals and includes an inert metal component and a reaction product formed by the reaction of the diamond in the first phase with a reactive, carbide-forming material. In a particular embodiment, the reaction product may operate partially fill the voids or pores left in the interstitial regions caused by the removal of the catalyst material (the remaining occupied by the inert metal component of the infiltrant) and impose a desired compressive stress onto the surrounding polycrystalline diamond matrix phase.

As described in greater detail below, the infiltrant alloy selected to form the second phases within this particular diamond-body region is one that includes at least two metals, one metal being a reactive, carbide-forming material useful for forming a carbide reaction product with carbon from the bonded-together diamond grains in this region, and the other metal being an inert species at the infiltration conditions and/or during use. A feature of the second regions is that they do not include or are substantially free of the catalyst material that was initially used to sinter the polycrystalline diamond matrix phase. As used herein, the term "catalyst material" is understood to refer to those materials that were initially used to sinter the PCD material, i.e., to facilitate the bonding together of the diamond crystals in the diamond body at HPHT conditions, and does not include materials that may be added subsequent to the sintering of the diamond body, e.g., in the form of an infiltrant or the components of the infiltrant to form the second phases.

As noted above, in an example embodiment, the infiltrant material used to fill the second phases may be provided in the form of an alloy comprising a carbide-forming metal and an inert metal that facilitates infiltration and/or that reduces the temperature needed to achieve desired infiltration during HPHT processing, without reacting or catalyzing reactions with diamond. The presence of the metal carbide and/or inert metal within the diamond body may be desired in certain applications calling for an enhanced degree of mechanical strength, e.g., strength and/or toughness, within the particular diamond region substantially free or devoid of the catalyst material. Further, the infiltrant material may be one that is selected to shift upwardly the graphitization temperature of the resulting diamond region containing the same, thereby operating to improve the thermal stability of the diamond construction. Additionally, the non-reactive/inert component of the infiltrant alloy may be selected to aid in diffusion or penetration of the carbide-forming metal into the voids in the diamond matrix phase without prematurely clogging the voids by carbide precipitation, but allowing for the desired speed of reaction between diamond and the carbide-forming metal. Use of an inert metal may also allow for the metal to remain in the second phase whilst still minimizing any potential for thermal degradation. Additionally, the presence of combination of a carbide-forming metal and an inert metal in the infiltrant may allow for the formation of a gradient within the second phases of the thermally stable region to help provide the desired hardness/toughness properties.

Accordingly, referring still to FIG. 1, the material microstructure of this diamond region devoid of the catalyst material includes a first matrix phase of bonded-together diamond grains 12, and a plurality of second phases 14 disposed within interstitial regions of the matrix. The reaction product between the diamond grains and the carbide-forming metal is formed within the second phases, which is also where the inert metal may remain. In a particular embodiment, the metal carbide and/or the inert metal fill all or a significant population of the of voids or pores resulting from the removal of the catalyst material.

Diamond grains useful for forming the diamond body during the HPHT process include diamond powders having an average diameter grain size in the range of from submicrometer in size to 0.1 mm, and more preferably in the range of from about 0.001 mm to 0.08 mm. The diamond powder may contain grains having a mono or multimodal size distribution. For example, the diamond powder may comprise a multimodal distribution of diamond grains comprising about 80 percent by volume diamond grains sized 20 to 30 micrometers, and 20 percent by volume diamond grains sized 1 to 6 micrometers. In an embodiment for a particular application, the diamond powder may have an average particle grain size of from about 5 to 30 micrometers. However, it is to be understood that the diamond grains having a grain size greater than this amount, e.g., greater than about 30 micrometers, may be used for certain drilling and/or cutting applications. In the event that diamond powders are used having differently sized grains, the diamond grains are mixed together by conventional process, such as by ball or attrittor milling for as much time as necessary to ensure good uniform distribution.

The diamond powder used to prepare the diamond body may be synthetic diamond powder. Synthetic diamond powder is known to include small amounts of solvent metal catalyst material and other materials entrained within the diamond crystals themselves. Alternatively, the diamond powder used to prepare the diamond body may be natural diamond powder. The diamond grain powder, whether synthetic or natural, may be combined with a desired amount of solvent catalyst to facilitate desired intercrystalline diamond bonding during HPHT processing.

Suitable catalyst materials useful for forming the PCD body may include metal solvent catalysts selected from Group VIII of the Periodic table (including cobalt, nickel, and iron), with cobalt (Co) being the most common, and mixtures or alloys of two or more of these materials. The diamond grain powder and catalyst material mixture may comprise 85 to 95% by volume diamond grain powder and the remaining amount catalyst material. In certain applications, the mixture may comprise greater than 95% by volume diamond grain powder. Alternatively, the diamond grain powder may be used without adding a solvent metal catalyst in applications where the solvent metal catalyst is provided by infiltration during HPHT processing from a substrate positioned adjacent the diamond powder volume.

In certain applications it may be desired to have a diamond body comprising a single diamond-containing volume or region, while in other applications it may be desired that a diamond body be constructed having two or more different diamond-containing volumes or regions. For example, it may be desired that the diamond body include a first diamond-containing region extending a distance from a working surface, and a second diamond-containing region extending from the first diamond-containing region to the substrate. Such diamond-containing regions may be engineered having different diamond volume contents and/or be engineered having differently sized diamond grains. It is, therefore, understood that the diamond constructions of this disclosure (including either the first, thermally stable region and/or the second region) may include one or multiple regions comprising different diamond densities and/or diamond grain sizes as called for by a particular cutting and/or wear end use application.

In an example embodiment, the diamond grain powder may be cleaned, and loaded into a desired container adjacent a desired substrate for placement within a suitable HPHT consolidation and sintering device. An advantage of combining a substrate with the diamond powder volume prior to HPHT processing may be that the resulting compact includes the substrate bonded thereto to facilitate eventual attachment of the compact to a desired wear and/or cutting device by conventional method, e.g., by brazing or welding or the like. In an example embodiment, the substrate includes a metal solvent catalyst for catalyzing intercrystalline bonding of the diamond grains by infiltration during the HPHT process.

Suitable materials useful as substrates include those materials used as substrates for conventional PCD compacts, such as those formed from ceramic materials, metallic materials, cermet materials, carbides, nitrides, and mixtures thereof. In a particular embodiment, the substrate may be provided in a preformed state and includes a metal solvent catalyst capable of infiltrating into the adjacent diamond powder mixture during HPHT processing used to initially form the PCD body to facilitate sintering and providing a bonded attachment with the resulting sintered body. Alternatively, the substrate may be provided in the form of a green state, i.e., unsintered, part, or may be provided in the form of a powder volume. It may desired that the metal solvent catalyst disposed within the substrate be one that melts at a temperature above the temperature used during the subsequent process of process of introducing the infiltrant material into the designated diamond body region and reacting the reactive material therein to form the desired reaction product. Suitable metal solvent catalyst materials include those selected from Group VIII elements of the Periodic table. A preferred metal solvent catalyst is cobalt (Co), and a preferred substrate material comprises cemented tungsten carbide (WC—Co).

The HPHT device may be activated to subject the container and its contents to a desired HPHT condition to consolidate and sinter the diamond powder mixture to form PCD. In an example embodiment, the device may be controlled so that the container is subjected to a HPHT condition comprising a pressure in the range of from 5 to 7 GPa and a temperature in the range of from about 1,320 to 1,600° C., for a sufficient period of time. During this HPHT process, the catalyst material present in the substrate melts and infiltrates the diamond grain powder to facilitate intercrystalline diamond bonding and bonding of the resulting diamond body to the substrate. During formation of the diamond body, the catalyst material migrates into interstitial regions within the diamond body disposed between the diamond grains.

Figure 2A:
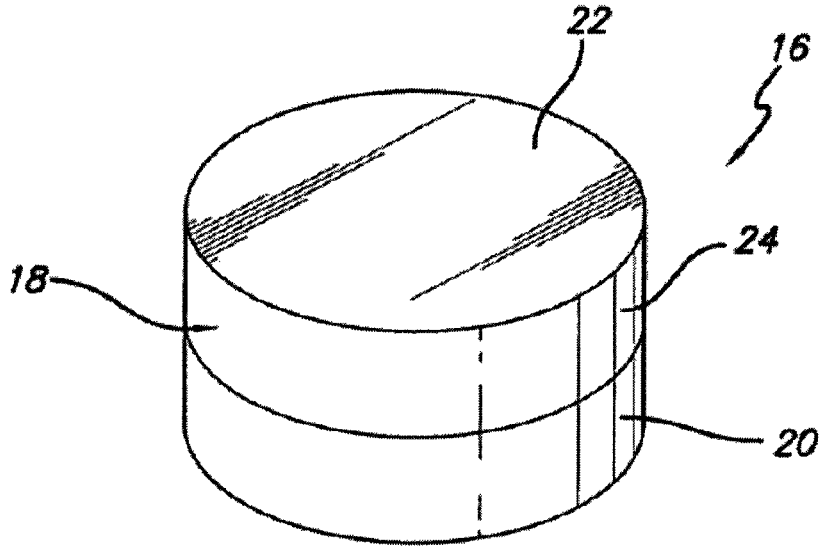
FIGS. 2A to 2E are perspective views of different compact embodiments comprising diamond constructions of this invention.
Figure 2B:
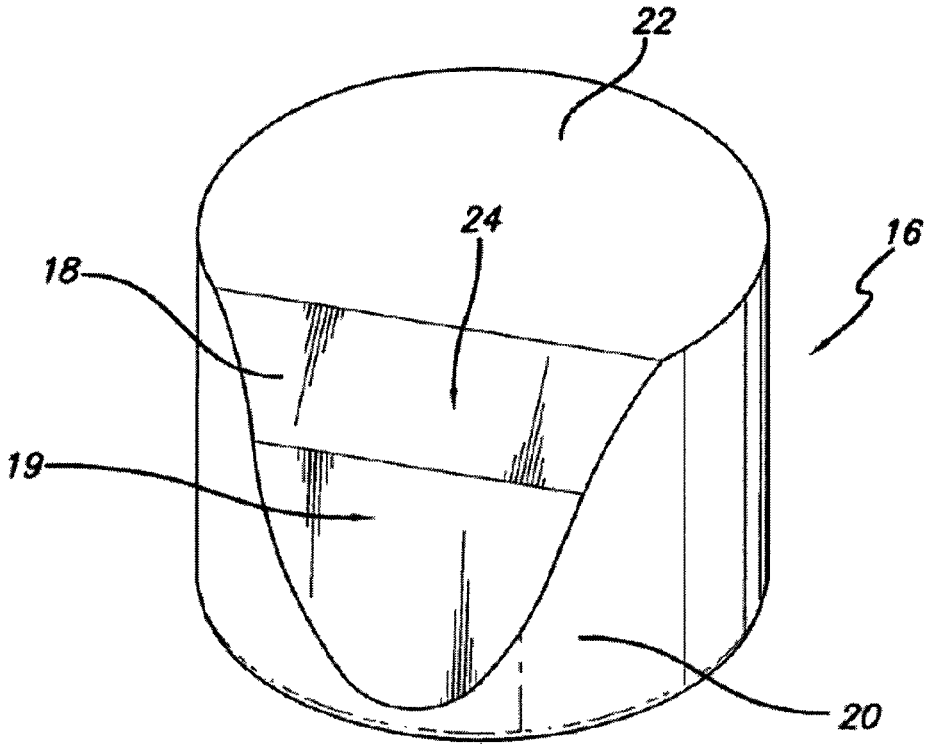
Figure 2C:
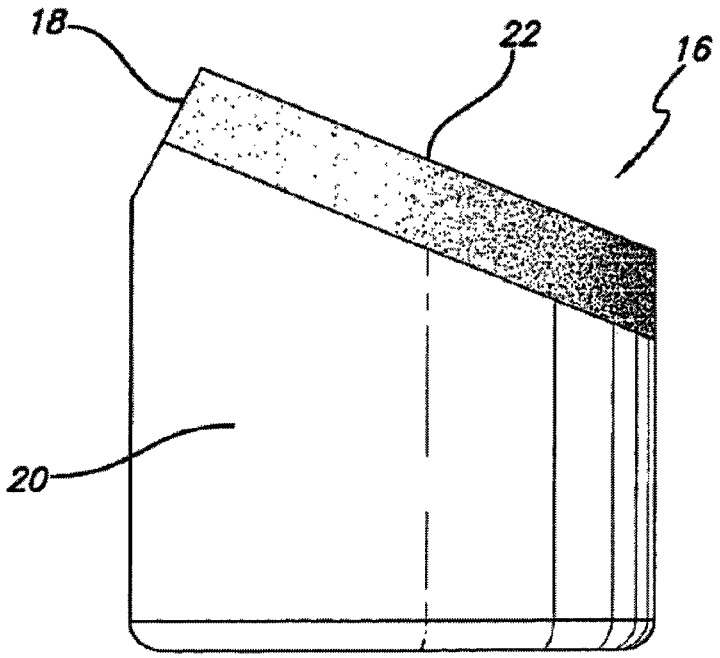
Figure 2D:
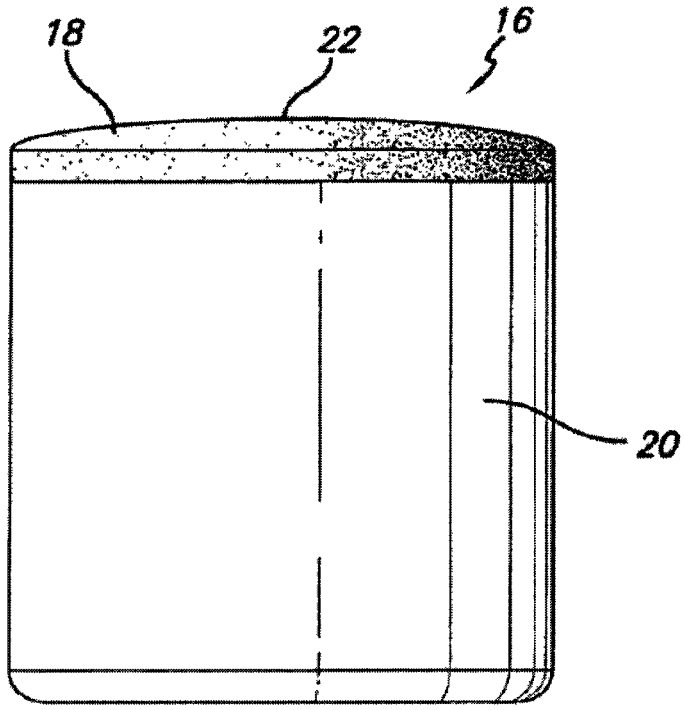
Figure 2E:
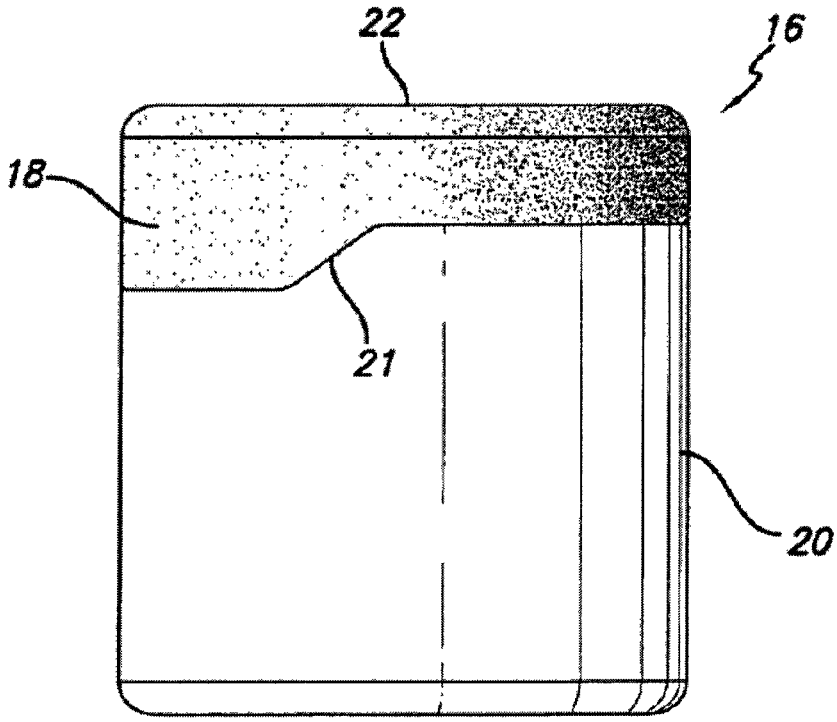

FIG. 2A illustrates a PCD compact 16 formed according to this process comprising a diamond body 18 formed from PCD and a substrate 20 attached thereto. The diamond body includes a working (upper and side) surface 22 positioned along a desired outside surface portion of the diamond body 18. In the example embodiment illustrated in FIG. 2A, the diamond body and substrate are each configured in the form of generally cylindrical members, and the working surface is positioned along an axial end across a diamond table of the diamond body 18.

It is to be understood that PCD compacts useful for forming diamond constructions of this invention may be configured differently, e.g., having a diamond body mounted differently on the substrate and/or having a working surface positioned differently along the diamond body and/or differently relative to the substrate. FIGS. 2B to 2E illustrate PCD compact embodiments that are configured differently than that illustrated in FIG. 2A for purposes of reference, and that are all useful for forming diamond constructions of this disclosure.

In an example embodiment, once formed, the diamond body 18 is treated to remove the catalyst material used to initially sinter and form the diamond body from a selected region thereof. This may be done, for example, by removing substantially all of the catalyst material from the selected region by suitable process, e.g., by acid leaching, aqua regia bath, electrolytic process, chemical processes, electrochemical processes or combinations thereof.

It is desired that the selected region where the catalyst material is removed, or the region of the diamond body that is devoid or substantially free of the catalyst material, be one that extends a determined depth from a surface of the diamond body independent of the diamond body orientation. Again, it is to be understood that the surface from which the catalyst material is removed may include more than one surface portion of the diamond body. In an example embodiment, it is desired that the region rendered substantially free of the catalyst material extend from a surface of the diamond body an average depth of at least about 0.010 mm. The exact depth of this region is understood to vary depending on such factors as the diamond density, the diamond grain size, and the ultimate end use application.

In an example embodiment, the treated region (and/or first, thermally stable region) may extend from the surface of the diamond body to an average depth that may broadly range from 0.01 to 3.0 mm, that may be less than about 0.1 mm for certain applications, or that may be greater than about 0.1 mm for other applications. In an example embodiment, the region that is rendered substantially free of the catalyst material (and subsequently infiltrated with an infiltrant material) extends from the surface of the diamond body an average depth of from about 0.05 mm to about 0.5 mm. As noted above, for more aggressive tooling, cutting and/or wear applications, the region rendered substantially free of the catalyst material may extend a depth from the working surface of greater than about 0.1 mm, e.g., up to 0.2 mm, 0.3 mm, 0.5 mm, or even 1.0 mm.

The diamond body may be machined, e.g., by OD grinding and/or polishing, to its approximate final dimension prior to treatment. Alternatively, the diamond-PCD compact may be treated first and then machined to its final dimension. The targeted region for removing the catalyst material may include any surface region of the body, including, and not limited to, the diamond table, a beveled section extending around and defining a circumferential edge of the diamond table, and/or a sidewall portion extending axially a distance away from the diamond table towards or to the substrate interface. In a particular embodiment, the diamond bonded body is machined finished to its approximate final dimension prior to treatment, which may or may not include the formation of a beveled section as noted above.

It is to be understood that the depth of the region removed of the catalyst material is represented as being a nominal or average value, e.g., arrived at by taking a number of measurements at preselected intervals along this region and then determining the average value for all of the points. The remaining/untreated region of the diamond body is understood to still contain the catalyst material and comprises PCD.

Additionally, when the diamond body is treated, it is desired that the selected depth of the region to be rendered substantially free of the catalyst material be one that allows a sufficient depth of remaining PCD so as to not adversely impact the attachment or bond formed between the diamond body and the substrate. In an example embodiment, it is desired that the untreated or remaining PCD region within the diamond body have a thickness of at least about 0.01 mm as measured from the substrate. It is, however, understood that the exact thickness of the PCD region may and will vary from this amount depending on such factors as the size and configuration of the diamond construction, and the particular diamond construction end-use application.

In an example embodiment, the selected region of the diamond body to be removed of the catalyst material is treated by exposing the desired surface or surfaces of the diamond body to acid leaching, as disclosed for example in U.S. Pat. No. 4,224,380, which is incorporated herein by reference. Generally, after the diamond body or compact is made by HPHT process, the identified body surface or surfaces, may be placed into contact with the acid leaching agent for a sufficient period of time to produce the desired leaching or catalyst material depletion depth.

Suitable leaching agents for treating the selected region include materials selected from the group consisting of inorganic acids, organic acids, mixtures and derivatives thereof. The particular leaching agent that is selected may depend on such factors as the type of catalyst material used, and the type of other non-diamond metallic materials that may be present in the diamond body In an example embodiment, suitable leaching agents include hydrofluoric acid (HF), hydrochloric acid (HCl), nitric acid ($HNO_3$), and mixtures thereof.

In an example embodiment, where the diamond body to be treated is in the form of a diamond compact, the compact may be prepared for treatment by protecting the substrate surface and other portions of the diamond body adjacent the desired treated region from contact (liquid or vapor) with the leaching agent. Methods of protecting the substrate surface include covering, coating or encapsulating the substrate and portion of PCD body with a suitable barrier member or material such as wax, plastic or the like.

Figure 3:
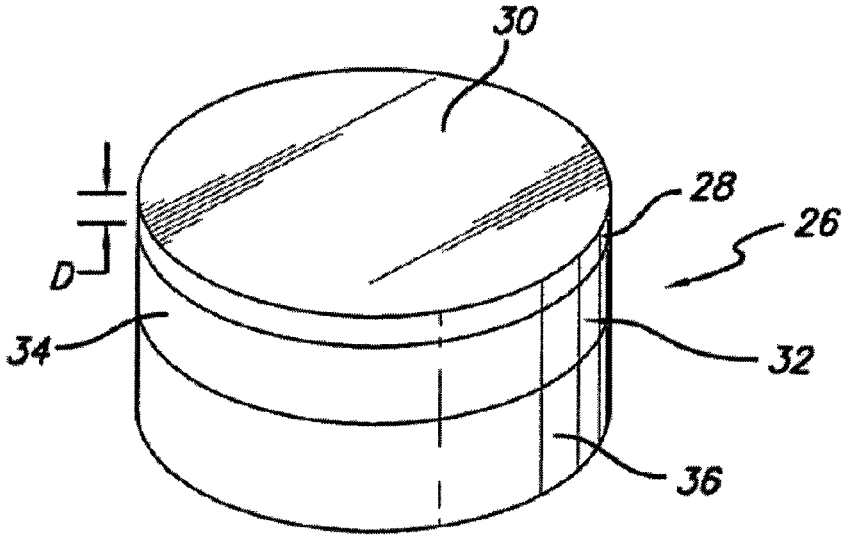
FIG. 3 is a perspective view of a diamond construction of this invention after a process step where a catalyst material has been removed from a region of the construction.
Figure 4:
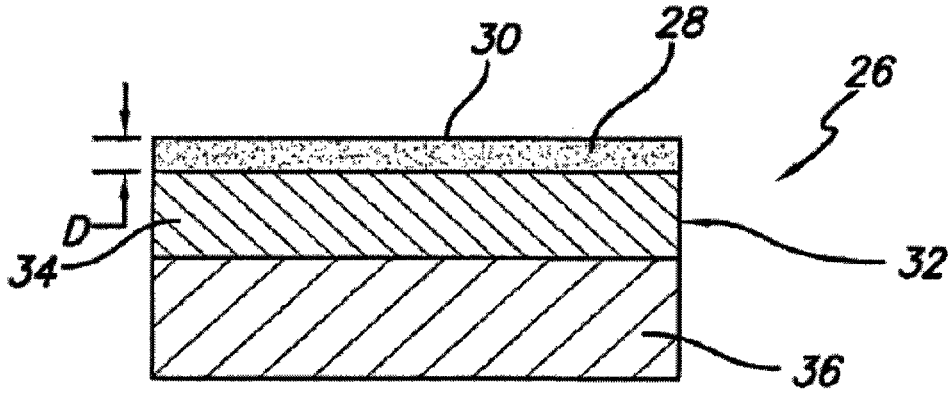
FIG. 4 is a cross-sectional side view of the construction of FIG. 3.

FIGS. 3 and 4 illustrate example embodiments of the diamond constructions 26 of this disclosure after the catalyst material has been removed from a selected region. The construction 26 comprises a treated region 28 that extends a selected depth "D" from a surface 30 of the diamond body 32. The remaining region 34 of the diamond body 32, extending from the treated region 28 to the substrate 36, comprises PCD having the catalyst material intact. As discussed above, the exact depth of the treated region having the catalyst material removed therefrom can and will vary.

Additionally, as mentioned briefly above, it is to be understood that the diamond constructions described above and illustrated in FIGS. 3 and 4 are representative of a single embodiment of this disclosure for purposes of reference, and that diamond constructions other than that specifically described and illustrated are understood to be within the scope of this invention. For example, diamond constructions comprising a diamond body having a treated region and then two or more other regions are possible, wherein a region interposed between the treated region and the region adjacent the substrate may be a transition region having a different diamond density and/or formed from diamond grains sized differently from that of the other diamond-containing regions.

Figure 5:
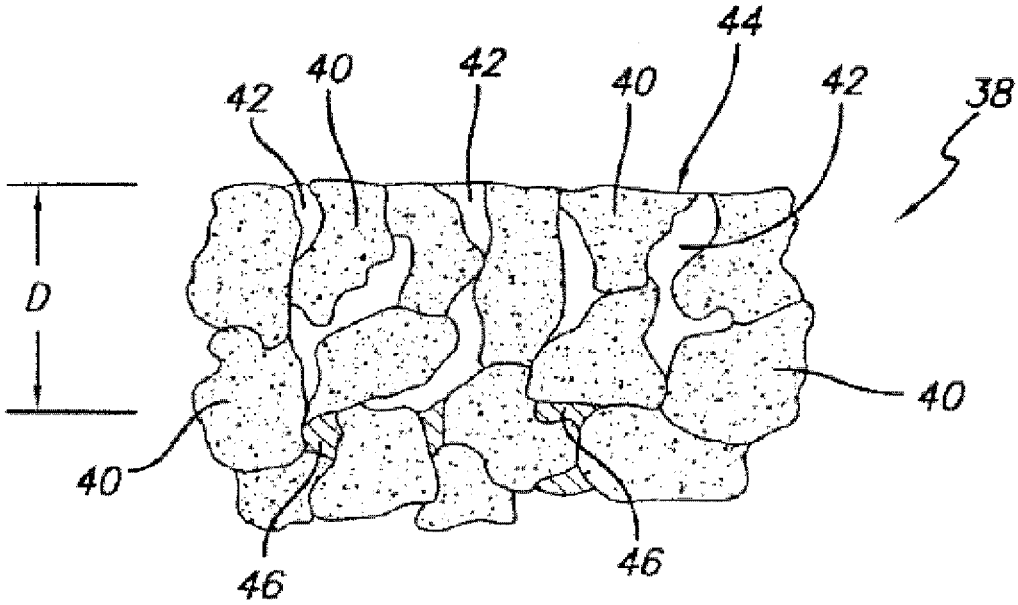
FIG. 5 is a schematic microstructural view taken of a section of the diamond construction where the catalyst material has been partially removed therefrom.

FIG. 5 illustrates the material microstructure 38 of the diamond constructions of this disclosure and, more specifically, the material microstructure taken from a section of the treated region. The treated region comprises a matrix phase of intercrystalline bonded diamond formed from a plurality of bonded-together diamond grains 40. The treated region also includes a plurality of interstitial regions 42 interposed between the diamond grains or crystals that are now substantially free of the catalyst material, i.e., that are now voids or empty pores. The treated region is shown to extend a distance "D" from a surface 44 of the diamond-boded body, wherein the interstitial regions 42 below the depth D are understood to include the catalyst material.

In one example embodiment, once the catalyst material is removed from the targeted region, the resulting diamond body is further processed to introduce an infiltrant material, as disclosed herein, to effect a desired reaction between the reactive, carbide-forming material and the diamond in the targeted region, form a gradient structure, and to optionally provide a layer of the reactive material and/or reactant product on a surface of the diamond body.

As discussed above, the infiltrant alloy material includes one or more reactive materials, and one or more other nonreactive and inert materials (does not react with the diamond crystals or catalytically function to cause diamond bond formation). In a particular embodiment, the infiltrant alloy material is selected from a combination of one or more reactive, carbide-forming metals with one or more nonreactive, inert metals that when combined has a melting temperature below that of the catalyst material used to form the diamond body and that still exists in the PCD region of the diamond body. The nonreactive, inert material also aids in the process of infiltrating the reactive material into the diamond body, and in an example embodiment, may be selected to control the rate of reaction between the reactive material and the diamond during the process of infiltration to thereby improve the degree of infiltration into the diamond region by the infiltrant material.

Example nonreactive, inert metals useful for forming the infiltrant alloy material of the present disclosure may include one or more metals selected from Cu, Ag, Au, Pd, and Pt. However, other metals that are non-reactive or non-catalyzing with carbon may also be used. It may be desired that the amount of the nonreactive, inert metal in the infiltrant alloy be sufficient to reduce the melting temperature of the infiltrant material, to a temperature below that of the catalyst material, and to provide a degree of control over the reactive material reaction rate, but yet minimize the tendency for such nonreactive material to act as a catalyst to the diamond during infiltration and/or during subsequent use of the diamond body in a wear or cutting operation.

It is theorized that the carbide-forming metal used in the infiltrant material reacts with the diamond crystals to form a barrier on the surface of diamond crystals. Thus, the plurality of second regions are believed to contain a reaction product (metal carbide) along an outer boundary adjacent the surrounding diamond crystals, and an inner portion that is surrounded by reaction product (metal carbide) that contains the nonreactive, inert metal. Additionally, the amount of the nonreactive material that is used may also be selected such that its presence within the plurality if second regions will not create a thermal expansion differential within the construction during use that will adversely impact performance or service life of the construction. Additionally, one skilled in the art, upon reading the teachings contained in the present application, would appreciate that the relative amount of metal carbide that forms in the second phases decreases extending away from the surface from which the infiltrant material infiltrated, whereas the inert metal increases in relative amount.

Preferably, the carbide-forming metal included in the infiltrant material is one that reacts with the diamond to form a reaction product therewith. In a preferred embodiment, the carbide-forming metal is one that is capable, alone or when combined with another material, of melting and reacting with diamond in the solid state during processing of the diamond materials at a temperature that is below the melting temperature of the catalyst material in the PCD region of the diamond body. Additionally, such carbide-forming metals would include those that, upon reacting with the diamond, form a compound having a coefficient of thermal expansion that is relatively closer to that of diamond than that of the catalyst material used to initially sinter the diamond body. Additionally, it is also desired that the compound formed by reaction of the reactive material with diamond have significantly high-strength characteristics.

The reactive, carbide-forming metal included in the infiltrant alloy is one that reacts with the diamond to form a reaction product therewith. In a particular embodiment, the reactive, carbide-forming material is one that is capable, alone or when combined with another material, of melting and reacting with diamond in the solid state during processing of the diamond materials at a temperature that is below the melting temperature of the catalyst material in the PCD region of the diamond body. Suitable reactive materials useful for forming diamond constructions of this disclosure may include, for example, Ti, Zr, Nb, Mo, W, Ta, V, Si, Cr, B, Hf, or any other element that will react with the carbon in the diamond crystals under the HPHT conditions to form a metal carbide. Additionally, such reactive materials would include those that, upon reacting with the diamond, form a compound having a coefficient of thermal expansion that is relatively closer to that of diamond than that of the catalyst material used to initially sinter the diamond body. Additionally, it may also be desired that the compound formed by reaction of the reactive material with diamond have significantly high-strength characteristics.

In an example embodiment, the infiltrant material may comprise in the range of from about 5 to 40 percent by volume nonreactive, inert metal, e.g., Cu, Ag, Au, Pd, or Pt, and a remainder amount of carbide-forming metal. It is to be understood that the amount of nonreactant, inert metal and reactive, carbide-forming metal used to form the infiltrant alloy can and will vary depending on the types of materials used.

In an example embodiment, a treated diamond body (having catalyst material removed therefrom) is loaded into a container for placement within the HPHT device for HPHT processing. Before being placed into the container, a desired infiltrant material is positioned adjacent a surface of the treated area of the diamond body to facilitate infiltration into the treated region during the HPHT process. During the HPHT process, the infiltrant material melts and infiltrates into the adjacent surface of the treated region of the diamond body and partially or completely fills the plurality of voids existing in the interstitial regions. As the infiltrant material infiltrates into the diamond body, the reactive, carbide-forming metal may react with the diamond crystals within the polycrystalline matrix phase to form a metal carbide within the interstitial regions, thereby forming the plurality of second phases within the material microstructure. Additionally, as the carbide-forming metal is depleted from the infiltrating phase (due to formation of metal carbides), the inert metal infiltrates deeper into the diamond body in order to produce a gradient between the infiltrant metal alloying components. Specifically, as the molten infiltrant alloys sweeps through the diamond body, the carbide-forming metal reacts with diamond, forming a metal carbide particles attached to the diamond crystals. As a result of this reaction, as the inert alloy penetrates into diamond body, the more depleted it becomes of the carbide-forming metal and, consequently, more rich in the inert metal component, leading to a gradient structure having more metal carbide and less inert metal close to the diamond body upper surface and less (or practically no) metal carbide and more inert moving away from the upper surface into the diamond body.

During the infiltration, the HPHT process may be conducted at a temperature sufficient to melt the infiltrant material, at a pressure high enough to keep the diamond thermodynamically stable, (this pressure may be lower than that used during the process of initially forming the diamond body due to the fact that this operation is carried out at lower temperatures than the forming process), and for a sufficient period of time, e.g., from about 1 to 20 minutes. This time period should be sufficient to melt all of the infiltrant material, to allow the carbide-forming metal to infiltrate the treated region of the diamond body to the desired extent react with the diamond crystals in this region to form the desired metal carbide occupying the plurality of second phases, and to allow the inert metal to infiltrated the treated region of the diamond body to the desired extent. Further, the HPHT temperatures may range from about 800 to 1700° C. (and from 900 to 1500° C. in a particular embodiment) depending on the selection of the infiltrant material. Further, the temperatures applied may depend, for example, on whether the diamond body being infiltrant has been rendered substantially free of the catalyst material or whether the catalyst material remains in a particular depth of the diamond body, and whether the diamond body being infiltrated is pre-attached to a substrate. If the substantially all of the interstitial regions are empty and the diamond body is not yet attached to a substrate, the temperatures must be raised sufficiently high (e.g., over 1450° C.) to allow for melting of the cobalt (or other Group VIII metal) and partial infiltration into the diamond body so that the substrate may be bonded thereto. In such an instance the temperature profile may include either a smooth increase through the melting temperatures of both infiltrants or may include a two-step process whereby the there is an intermediate hold stop.

Additionally, to create the gradient structure within the first, thermally stable region, the temperatures during the HPHT process may be controlled to allow for both infiltration as well as reaction. Specifically, the temperature increase (upon reaching the melting of the infiltrant) must be slow enough to achieve a gradient and must be fast enough to avoid clogging of the pores by the metal carbide. Thus, upon reaching the melting of the infiltrant, the temperature may increase at a rate between about 1 and 100° C./sec, and between about 2 and 50° C./sec or between about 5 and 25° C./sec in other embodiments.

While particular HPHT pressures, temperatures and times have been provided, it is to be understood that one or more of these process variables may change depending on such factors as the type and amount of materials used to form the infiltrant material, and/or the type of diamond body. It may generally be desired, however for this particular embodiment, that the HPHT process for infiltrating the infiltrant material be below the melting temperature of the catalyst material remaining in the PCD region of the diamond body, to permit the infiltrant material to infiltrate and react with the diamond crystals without the catalyst material in the PCD region infiltrating into the treated region.

The infiltrant material, when introduced by HPHT process, may be provided in the form of a solid object such as a metal alloy foil, or may be provided in the form of a powder that is positioned adjacent a surface of the treated region of the diamond body, thereby infiltrating during the HPHT process into the treated region to fill the voids and pores disposed therein formed by removal of the catalyst material.

Other methods of introducing the infiltrant material into the diamond body may be by coating or partially infiltrating the body surface and voids in the treated region prior to placing the body in the HPHT device by processes such as Chemical Vapor Deposition (CVD) or Physical Vapor Deposition (PVD). Other methods such as wet chemical plating, or electro-deposition, or filling the voids with the infiltrant material provided in a liquid phase, e.g., via an organic or inorganic liquid carrier may also be employed. Such methods of introducing the infiltrant material to the diamond body, i.e., to the treated region, may be used as an alternative or in addition to introducing the infiltrant material during the HPHT process.

When the infiltrant material is provided in the form of a coating prior to placement of the diamond body in the HPHT device, the infiltrant material may achieve a desired degree of penetration into the treated material to fill the empty voids within the treated region. The exact depth of penetration can and will vary on a number of factors such as the type of coating technique used, the types of materials used to form the infiltrant material, and the type of material used to form the diamond body. An advantage of using such a coating technique to introduce the infiltrant material into the diamond body is that it may result in a smaller volume change during HPHT processing, which would also provide a more predictable and controlled HPHT process and resulting product.

A further advantage of introducing some or all of the infiltrant material in this manner is that it may reduce the amount of entrained gas in the product formed during the HPHT process, which would also help achieve a compact having a higher material density and possibly having better heat transfer properties, i.e., resulting from reducing the total volume of unfilled void space within the construction, thereby reducing the amount of heat transfer by convection and increasing the amount of heat transfer by conduction, which can operate to increase the overall heat transfer capability of the resulting diamond body. Reducing the amount of entrained gas within the compact is also desired during the HPHT process as such gas operates to potentially reduce the extent of desired chemical reactions between the reactive material and the polycrystalline phase material.

If the infiltrant material is applied to the diamond body prior to HPHT processing, the resulting diamond body is then subjected to the HPHT process as described above to achieve any further desired extent of infiltration in addition to producing the desired reaction product between the reactive material and the polycrystalline matrix phase material.

Alternatively, the infiltrant material may be provided in the form of a slurry or liquid or a gel, e.g., in the form of a sol gel, polymer material or the like, comprising the desired alloy. In an example embodiment, when the infiltrant material is provided in the form of a liquid or sol gel, it may be introduced into the diamond body at a relatively low temperature without the need to elevated temperature. In an example embodiment, the infiltrant material may be introduced into the diamond body at a temperature of at least 800° C. for a sufficient amount of time to provide a desired degree of infiltration and reaction product without having to use elevated pressure. Accordingly, using an infiltrant material in such a form enables infiltration to take place by subjecting the diamond body to the liquid infiltrant material, e.g., by immersion or the like, under elevated temperature conditions, e.g., by using an autoclave or the like. The diamond body may then be placed in a vacuum furnace and the desired reaction product, e.g., the metal carbide, may be formed at a temperature of at least about 700° C.

In one embodiment, the infiltrant material may infiltrates into the entire diamond body treated region, thereby providing a thermally stable diamond region extending a desired depth from the working surface. In certain situations, however, it may be difficult for the infiltrant material to infiltrate and fill the entire treated region, in which case a portion of the treated region may not be filled with the infiltrant material and such portion may still include some population of unfilled or partially filled voids or pores. Alternatively, it may be intentionally desired that some population of the voids in the treated region remain unfilled. This may be desired, for example, for the purpose of providing a thermally and/or electrically insulating layer within the diamond body. Accordingly, it is to be understood that plurality of voids or empty pores existing in the diamond body treated region may be completely or only partially filled with the infiltrant material (the inert metal and/or the metal carbide reaction product).

In a particular embodiment, all or a substantial portion of the voids or pores in the treated region are filled with the infiltrant alloy (or constituent components thereof), thus all or a substantial population of the voids or empty pores existing in this region will contain the reactive material (in the form of a metal carbide) and/or the inert metal. It is understood that in those cases that the pores or empty voids that are filled or partially filled with such infiltrant material may, in addition to the metal carbides and/or inert metal, the second phases may also include some unreacted reactive, carbide-forming metal. However, in a preferred embodiment, substantially all of the carbide-forming material in the infiltrant material is reacted.

This reaction between the carbide-forming metal and carbon present in the diamond crystals may be desired because the reaction product, the metal carbide, may have a coefficient of thermal expansion that is closer to diamond than that of the catalyst material that was initially used to sinter the diamond body and that remains within the PCD region of the diamond body. Additionally, the presence of the metal carbide may provide improved properties of strength and fracture toughness to the diamond body when compared to the preexisting state of the treated region of the diamond body comprising empty voids or pores.

Further, the presence of metal carbide and/or inert metal in the second phases adjacent the interface between the diamond body region comprising the same and the PCD region may operate to minimize or dilute the otherwise large difference in the coefficient of thermal expansion that would otherwise exist between these regions, thereby operating to minimize the development of thermal stress in at the interface between the treated and untreated diamond body regions, thereby improving the overall thermal stability of the entire diamond body.

It is to be understood that the amount of the infiltrant material used for forming diamond constructions of this invention can and will vary depending on such factors as the size and volume content of the diamond crystals in the treated region, the volume of the treated diamond region to be infiltrated, the type of materials used to form the infiltrant material, the desired layer thickness of reactive material internally within the region on the diamond crystals, the formation and thickness of any material layer on a surface of the diamond body, in addition to the particular end-use application for the resulting diamond construction. In one embodiment, the amount of the infiltrant material used may be sufficient to infiltrate a desired volume of the treated region and form the desired reaction product having a desired thickness within the interstitial regions of the treated region. As note above, optionally, the amount of infiltrant material used may also take into account the formation of a material layer having a desired thickness formed on at least a portion of the diamond body surface.

In an example embodiment, the source of the infiltrant alloy is provided in the form of a metal alloy disk. However, other geometric shapes of alloy may be used to vary the infiltration profile in the diamond body, as described in FIGS. 8A-9B. As noted above, the amount of carbide-forming metal that is used may influence the depth of infiltration, the extent of diamond bonding via the resulting reaction product, and the thickness any material layer formed on at least a portion of the diamond body surface. In an example embodiment, where the diamond body has a diameter of approximately 16 mm and the leach depth is approximately 0.08 mm, the volume of the infiltrant material needed to fill the interstitial regions will depend on the extent of the porosity within this region. As an example, when the porosity in such example is approximately 5 percent, approximately 0.8 cubic mm of the infiltrant material may be used, and when the porosity in such example is approximately 10 percent, the amount of infiltrant material will be greater by a factor of 2 or 1.6 cubic mm.

Although formation of the thermally stable diamond region has been described by using a single infiltrant material, it is to be understood that such diamond region may be formed by using two or more infiltrant materials. For example, a first infiltrant material comprising a first reactive material can be used to occupy some population of the voids disposed within the treated diamond body, and a second infiltrant material comprising second reactive material can be used to occupy some other population of the voids. In such example embodiment, the first infiltrant material may be used to fill the voids in one particular region, e.g., a region nearest the diamond-body surface, while the infiltrant reactive material may be used to fill the voids in another particular region, e.g., a region adjacent the PCD region. In addition to using two or more infiltrant materials to form different volumes within the thermally stable region, the infiltrant material may be combined so that they occupy the same volume within the thermally stable region.

It is to be understood that the particular infiltrant materials that are used in each such embodiments may be tailored to provide the desired thermal and/or mechanical properties for each such portion of the thermally stable region, thus providing a further ability to customize the performance properties of the thermally stable region in the diamond body to meet the specific demands of a particular end-use application.

In another example embodiment, diamond constructions are prepared by removing the catalyst material used to form the diamond body completely therefrom rather than by removing the catalyst material from only a targeted region of the diamond body. In such embodiment, a diamond body comprising PCD is formed in the manner described above by HPHT process, and the entire so-formed PCD body is treated to remove the catalyst material therefrom so that the resulting entire diamond body is substantially free of the catalyst material.

In such embodiment, the resulting catalyst free diamond body is then subjected to a treatment whereby the infiltrant material (as discussed above) is introduced into a region of the body to occupy the empty pores or voids in such region, and to form the desired reaction product within the pores. Additionally, the catalyst free diamond body is treated so that the empty pores or voids in another region of the body are filled with another infiltrant, wherein such other infiltrant is different from that used to produce the reaction product.

The other infiltrant that is used to fill the pores in the other region of the diamond body may be formed from materials that assist in providing a desired degree of fracture toughness and mechanical strength to the diamond body. Further, it may be desirable that such other infiltrant be one that is capable of providing a bonded attachment with a desired substrate to form a diamond compact. Suitable materials that may be used as the other infiltrant includes those in Group VIII of the Periodic table and alloys thereof, including cobalt, iron, and nickel. Other suitable materials that may be used as the other infiltrant can include nonrefractory metals, ceramic materials, cermet materials, and combinations thereof. The other infiltrant may or may not include a constituent that can react with the diamond within the diamond body to form a reaction product, i.e., the other infiltrant may include a carbide former or the like. In a particular embodiment, the other infiltrant is cobalt. A feature of the material that is used to form the other infiltrant is that it may have a melting temperature higher than that of the infiltrant used to introduce the reactive material to form the reaction product.

Such other example embodiment diamond body is formed by treating the entire diamond body to remove the catalyst material therefrom by the same method as described above, e.g., by acid leaching process of the like. Where the PCD body includes a substrate, the substrate may be removed prior to treatment to facilitate the catalyst removal process, or may be removed and/or allowed to fall away from the diamond body after the treatment, by virtue of the catalyst material no longer being present to provided a bonded attachment therebetween.

The resulting diamond body is substantially free of the catalyst material and is loaded into a container for subsequent HPHT processing. A source of the infiltrant is positioned adjacent a desired surface of the diamond body for receiving the infiltrant therein, and a source of the other infiltrant is positioned adjacent another desired surface of the diamond body for receiving the other infiltrant therein. In an example embodiment, the source of the infiltrant used for introducing the reactive metal and inert metal may be in the same form as that described above, and in an example embodiment, is provided in the form of a foil. In an example embodiment, the source of the other infiltrant may be provided in the form of a substrate, that can be in the same form and/or formed from the same materials described above for forming the PCD diamond body. In an example embodiment, a WC—Co substrate is used as the source of the other infiltrant, wherein the other infiltrant is cobalt.

In an example embodiment, the infiltrant may be positioned to cover working surfaces of the diamond body, which may include the same diamond body surfaces described above, e.g., including the diamond table, wall surface, and/or beveled edge. In an example embodiment, the other infiltrant is positioned along a surface of the diamond body where a desired attachment to a substrate is desired, which can vary depending on the particular end-use application.

The container is loaded into an HPHT device and the device is operated to cause a sequential melting and infiltration of the infiltrant material comprising reactive material, and then the melting and infiltration of the other infiltrant material. The extent of infiltration, i.e., the depth of infiltration into the diamond body, by the infiltrant material comprising the reactive material may be controlled by the volume of the infiltrant material that is provided and/or by the extent of time that the HPHT process is held at the infiltrant melting temperature and/or the reaction material reaction temperature. In an example embodiment, the volume of infiltrant material that is provided and/or the duration that the HPHT process is held at the infiltrant melting temperature is such as sufficient to facilitate formation of a region within the diamond body comprising the reaction product within the pores to depth as described above.

The HPHT device may be operated to provide a stepped temperature change from a first temperature (to melt the infiltrant comprising the reaction metal and the inert metal) to a second temperature (to melt the other infiltrant) after a sufficient period of time has passed. Alternatively, the HPHT device may be operated to provide a gradient temperature change moving gradually from the first temperature to a second temperature over a sufficient period of time. In both operations, the sufficient period of time is that which permits formation of the region within the diamond body having the reaction product within the pores to the desired depth.

Once the desired depth of the diamond body region comprising the reaction product is formed, the temperature of the HPHT device increases to the melting temperature of the other infiltrant to cause it to melt and infiltrate into a region of the diamond body not already filled with the reaction product and inert metal. In the example embodiment where the other infiltrant is provided as a constituent of a substrate, such infiltration of the other infiltrant operates to form a bonded attachment between the diamond body and the substrate. The HPHT device may be operated at this higher temperature for a period of time sufficient to fill the other region of the diamond body and/or to ensure that a desired attachment bond is formed between the diamond body and the substrate.

In such example embodiment, the resulting diamond body may include a first, thermally stable region (having a gradient within the interstitial regions between the bonded-together diamond of a metal carbide and the inert metal) and a second region (having the other infiltrant material disposed within the interstitial regions). In a particular embodiment, the other infiltrant material may be a Group VIII metal (such as Co, Ni, or Fe) that infiltrates into the second region from a substrate to which the diamond body is bonded. There may be some overlap or an interface between the first and second regions, or alternatively there may be a region within the diamond body between the two regions that possesses empty interstitial regions. In an example embodiment, the first region extends a depth within the diamond body as described above, and the second region extends between the first region and the substrate.

Figure 6:
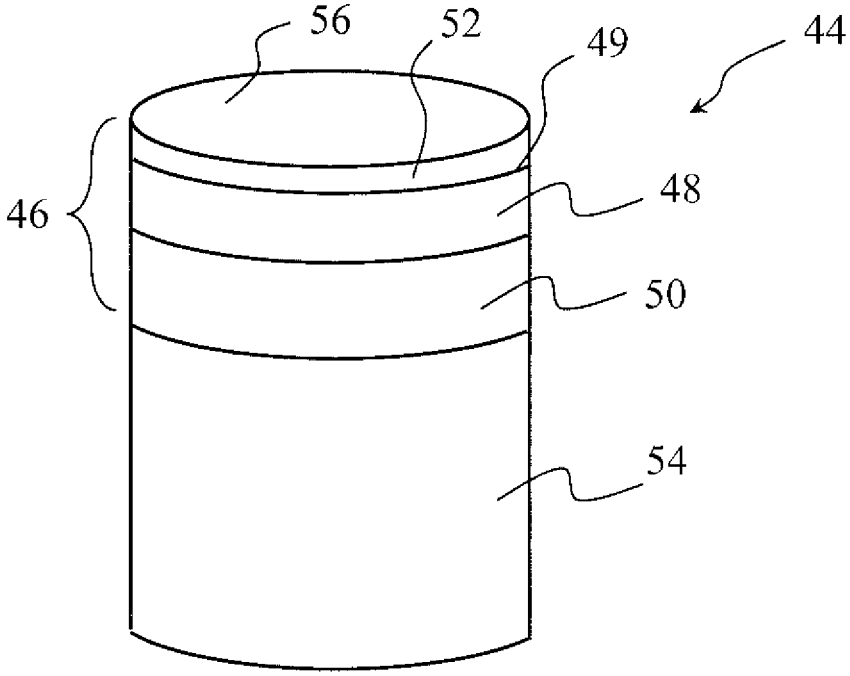
FIG. 6 is a perspective view of a diamond construction of this invention after a process step where an infiltrant material has been introduced into the construction after partial removal of the catalyst material.

FIG. 6 illustrates a perspective view of a thermally stable diamond construction 44 constructed according to principles described above. Generally speaking, such construction 44 comprises a diamond body 46 having the thermally stable diamond region 48 extending a depth from a diamond body upper surface 49, and a further region 50 that either comprises conventional PCD (i.e., that includes the catalyst material used to form the diamond body) or that comprises a region including another infiltrant disposed within the interstitial regions that is not the catalyst material that was used to initially form the diamond body. The construction 44 may optionally include a material layer 52 that is disposed along at least a portion of a surface of the diamond body. It is to be understood, the diamond constructions of this disclosure may be formed with or without the material layer 52, depending on the particular end-use application. The material layer 52 is formed from the infiltrant material and, in an example embodiment, comprises the reaction product formed by reaction of the reactive carbide-forming metal with the diamond in the diamond body. The construction 44 illustrated in FIG. 6 is provided in the form of a compact comprising a substrate 54 attached to the diamond body 46. In an example embodiment, the substrate 54 is attached to the diamond body 46 via the region 50.

As described above, the optional material layer 52 may be formed during the HPHT process of infiltrating the infiltrant material (and reaction of the carbide-forming metal with the diamond) within the diamond body, during which process the material layer is formed in situ during infiltration and reaction product formation. Alternatively, the material layer 52 may be formed separately from the HPHT process used to form the reaction product within the diamond body, e.g., by depositing a desired thickness of the infiltrant material onto the designated surface of the diamond body, and then subjecting the surface to temperature and/or pressure conditions sufficient to form the reaction product on the diamond body surface. Further still, the material layer may be formed independent of the HPHT process by depositing a desired thickness of a metal carbide onto a surface of the diamond body by CVD, PVD or other conventional processes.

The thickness of the material layer can and will vary depending on the particular diamond body size, shape, and end-use application, as well as the material selected for forming the material layer. In an example embodiment, the material layer thickness may be less than about 100 micrometers, preferably in the range of from about 0.5 micrometers to 50 micrometers, and more preferably in the range of from about 5 to 30 micrometers. It is also within the scope of the present disclosure that the material layer 52 be formed during the HPHT process and then subsequently be removed, such as by machining or finishing, depending on the desired end use of the diamond construction.

While the diamond construction 44 is illustrated having a generally cylindrical wall surface with a working surface 56 positioned along an axial end of the construction, it is to be understood that diamond constructions of this disclosure may be configured having a variety of different shapes and sizes, with differently oriented working surfaces, depending on the particular wear and/or cutting application, e.g., based on the different PCD compact constructions illustrated in FIGS. 2B to 2E.

Figure 7A:
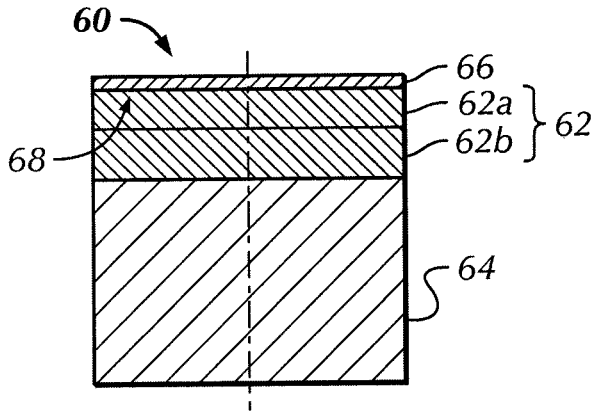
FIGS. 7A and 7B are cross-sectional side views of a diamond construction of this disclosure.
Figure 7B:
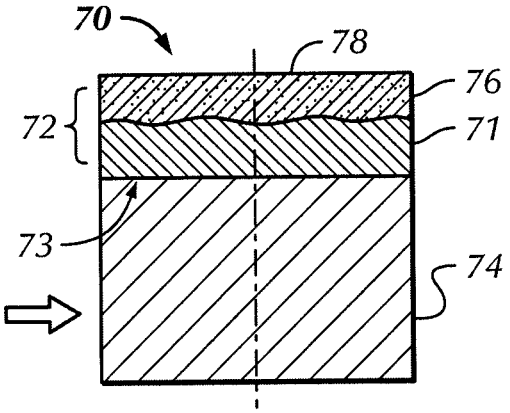

FIGS. 7A-7B illustrate cross-sectional side views of a diamond construction 70 of this disclosure. FIG. 7B illustrates the construction 70 formed from the components 60 shown in FIG. 7A. As shown in FIG. 7A, a diamond body 62 is placed on a substrate 64 (or may be bonded thereto), and an infiltrant material 66 is placed on the opposing surface of the diamond body 62. In this embodiment, diamond body 62 includes two regions, a treated region 62*a* (whereby the catalyst material has been removed therefrom), and an untreated region 62*b*; however, other embodiments of the present disclosure may provide for infiltration of a diamond body that has been completely treated such that the entire body is substantially free of catalyst material. Upon HPHT sintering, infiltrant material 66 infiltrates into the pores of the diamond body 62, specifically, the treated region 62*a*. Because diamond body includes untreated region 62*b*, metal from the substrate 64 need not infiltrated into the diamond body so long as the diamond body is already sintered to the substrate 64. The resulting construction 70 has a diamond body 72 that is attached to a substrate 74. The diamond body 72 includes a thermally stable diamond region 76 that extends a depth from a surface 78 of the diamond body. The thermally stable diamond region 76 has a material microstructure comprising a polycrystalline diamond matrix first phase of bonded together diamond crystals, and a second phase disposed interstitially within the matrix phase, as best illustrated in FIG. 1. The contents second phase of the thermally stable diamond region 76 include metal carbide and an inert metal, with the two existing as a gradient structure of greater relative amounts of metal carbide nearer the surface 78 and greater relative amounts of inert metal nearer the second region. Because the second phase is disposed within the interstitial regions of the material microstructure that previously existed as voids, the second phase may also be referred to herein as a plurality of second phases as such are dispersed throughout the matrix phase. As noted above, this region 76 may have an improved degree of thermal stability when compared to conventional PCD, due both to the absence of the catalyst material used to form the diamond body and to the presence of the metal carbide (particularly near the surface 78) and inert metal, as this metal carbide has a coefficient of thermal expansion that more closely matches diamond as contrasted to a catalyst material such as cobalt.

The diamond body 72 includes another region 71, which may be a conventional PCD region or a diamond region that includes another infiltrant and that is substantially free of the catalyst material used to initially form the diamond body. This other, or second, region 71 extends a depth from the thermally stable diamond region 76 through the body 72 to an interface 73 between the diamond body and the substrate 74. As noted above, in an example embodiment, the other region 71 may facilitate an attachment bond with the substrate, thereby ensuring use and attachment of the resulting diamond construction to a desired end-use application device by conventional means like welding, brazing or the like.

The first region 76 may extend from the surface of the diamond body to an average depth that may broadly range from 0.01 to 3.0 mm, that may be less than about 0.1 mm for certain applications, or that may be greater than about 0.1 mm for other applications. In a particular embodiment, first region 76 extends from the surface of the diamond body an average depth of from about 0.05 mm to about 0.5 mm. As noted above, for more aggressive tooling, cutting and/or wear applications, the region rendered substantially free of the catalyst material may extend a depth from the working surface of greater than about 0.1 mm, e.g., up to 0.2 mm, 0.3 mm, 0.5 mm, or even 1.0 mm. In other embodiments, the first region 76 may extend a depth into diamond body 72 that is 5 to 95% of the total depth of the diamond body 72, in a particular embodiment. In other embodiments, the first region 76 may extend a depth into the diamond body 72 that is the total depth of the diamond body 62 less 0.1 mm, which is occupied by the second region 71. Further, within the first region 76, the portion of the first region 76 that interfaces the second region 71 may possess in its interstitial regions a metal carbide that occupies 0 to about 50% by volume of the interstitial, where the volume percent of metal carbide within the interstitial regions increases moving towards the upper (or side) surface 78 of diamond body 72.

Figure 8A:
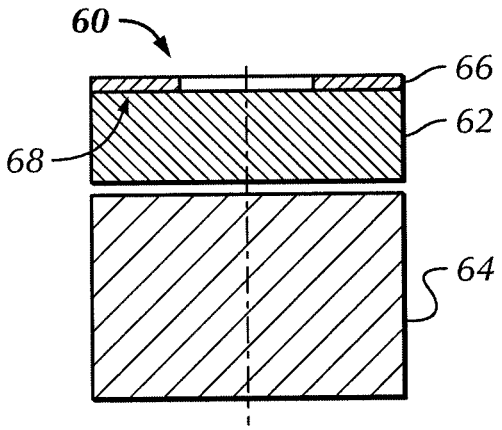
FIGS. 8A and 8B are cross-sectional side views of a diamond construction of this disclosure.
Figure 8B:
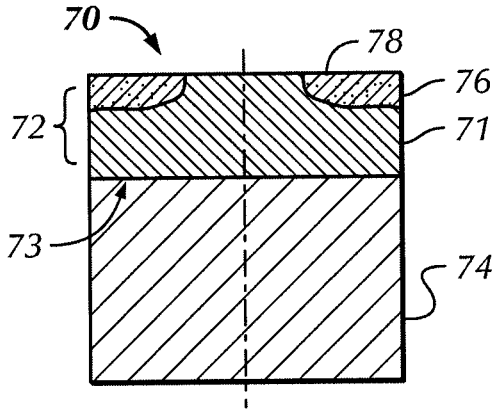

FIGS. 8A-8B are similar to the embodiment shown in FIG. 7A-7B. However, in the embodiment illustrated in FIGS. 8A-8B, the entire diamond body 62 has been treated so that substantially all of the pores are free of a catalyst material. In addition to this difference, the infiltrant metal 66 is provided in the form of a ring that is laid upon the upper surface 68 of the diamond body 62, so that upon formation of the construction 70, the thermally stable diamond region 76 (having the gradient as described with respect to FIG. 7B is not present as a uniform layer, but is instead takes an annular shape. In such an embodiment, the thermally stable region 76 is present along the cutting portion of the construction 70 while maximizing the amount of the PCD region 71 (having the catalyst material or a subsequently infiltrated Group VIII metal).

Figure 9A:
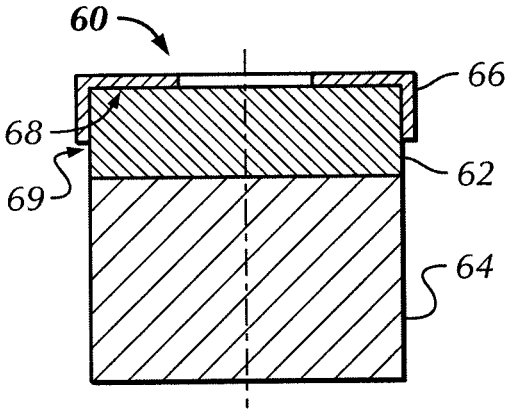
FIGS. 9A and 9B are cross-sectional side views of a diamond construction of this disclosure.
Figure 9B:
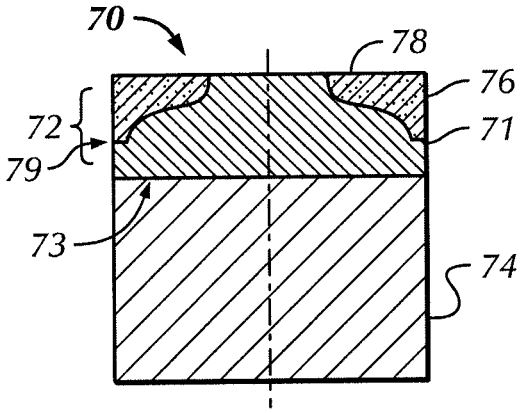

FIGS. 9A-9B are similar to the embodiment shown in FIG. 7A-7B. However, in the embodiment illustrated in FIGS. 9A-9B, the infiltrant metal 66 is provided in the form of a ring having an flange extension so that a portion of the side surface 69 of the diamond body is covered by the infiltrant 66. Upon HPHT conditions, the construction 70 may possess a thermally stable region 76 with a similar profile as the infiltrant metal, whereby the thermally stable region 76 extends circumferentially around the diamond body 72 side surface 79 a partial depth as well as a partial depth from a portion of the upper surface. Other embodiments may also allow for the use of a disk having a flange extension to allow for the formation of a thermally stable region that extends circumferentially around the diamond body side surface a partial depth, as well as a partial depth from the entire upper surface.

Diamond constructions of this disclosure will be better understood with reference to the following examples:

Example 1

Diamond Construction by Partial Leaching

Synthetic diamond powder having an average grain size of approximately 2 to 50 micrometers is mixed together for a period of approximately 2-6 hours by ball milling. The resulting mixture is cleaned by heating to a temperature in excess of 850° C. under vacuum. The mixture is loaded into a refractory metal container. A WC—Co substrate is positioned adjacent a surface of the diamond powder volume. The container is surrounded by pressed salt (NaCl) and this arrangement is placed within a graphite heating element. This graphite heating element containing the pressed salt and the diamond powder and substrate encapsulated in the refractory container is loaded into a vessel made of a high pressure/high temperature self-sealing powdered ceramic material formed by cold pressing into a suitable shape.

The self-sealing powdered ceramic vessel is placed in a hydraulic press having one or more rams that press anvils into a central cavity. The press is operated to impose an intermediate stage processing pressure and temperature condition of approximately 5,500 MPa and approximately 1,450° C. on the vessel for a period of approximately 5 minutes. During HPHT processing, cobalt from the WC—Co substrate infiltrates into the adjacent diamond powder mixture, and intercrystalline bonding between the diamond crystals takes place forming PCD.

The vessel is opened and the resulting PCD compact is removed therefrom. A region of the PCD body is treated by acid leaching to remove the catalyst material, i.e., cobalt, therefrom to a depth of approximately 0.055 mm. After the leaching treatment is completed, the treated diamond body with substrate bonded thereto is again loaded into the HPHT device and a infiltrant material comprising a metal alloy disk (containing at least one of Cu, Ag, Au, Pd, or Pt and at least one of Ti, Zr, Nb, Mo, W, Ta, or V) is positioned adjacent the treated region. The HPHT device is operated to impose approximately 5,500 MPa and approximately 1,100° C. for a period of approximately 2 minutes. During which time the infiltrant material melts and infiltrates into the treated region to fill the empty voids and pores created by removing the catalyst material, and the at least one of Ti, Zr, Nb, Mo, W, Ta, or V reacts with the diamond crystals to form a reaction product, i.e., TiC, ZrC, NbC, MoC, WC, TaC, or VC. Further, during this HPHT process the other metal also infiltrates into the diamond body, and as the Ti, Zr, Nb, Mo, W, Ta, or V is reacted/depleted, the Cu, Ag, Au, Pd, or Pt infiltrates deeper into the diamond body and becomes the primary component within the interstitial regions of the diamond body in the treated region.

The so-formed diamond construction has a diamond body with a thermally stable diamond region of approximately 0.055 mm thick having a microstructure characterized by a polycrystalline diamond matrix first phase and a metal carbide and/or inert metal second phase occupying a major population of the empty voids. The total diamond body thickness may be approximately 2.5 mm, and the PCD region would have a thickness of approximately 1.95 mm. The diamond body PCD region may be attached to the WC—Co substrate having a thickness of approximately 13 mm. Further, these thicknesses are representative of a single example construction, and the scope of the present disclosure is not so limited. Rather, other diamond table thicknesses, as well other thermally stable region thicknesses, may be used as described above.

Example 2

Diamond Construction by Complete Leaching

A PCD body is prepared in the same manner described above in Example 1. However, the entire PCD body is treated by acid leaching to remove the catalyst material, i.e., cobalt, therefrom. Before the body is treated, the substrate is removed to facilitate the process of removing the catalyst material therefrom. After the leaching treatment is completed, the treated diamond body is loaded into the HPHT device and a infiltrant material comprising a metal alloy disk (containing at least one of Cu, Ag, Au, Pd, or Pt and at least one of Ti, Zr, Nb, Mo, W, Ta, or V) is positioned adjacent a first region of the body and a WC—Co substrate is positioned adjacent a second region of the body.

The HPHT device is operated to impose approximately 5,500 MPa and approximately 1,100° C. for a period of approximately 2 minutes. During this time the infiltrant material melts and infiltrates into the treated region to fill the empty voids and pores created by removing the catalyst material, and the at least one of Ti, Zr, Nb, Mo, W, Ta, or V reacts with the diamond crystals to form a reaction product, i.e., TiC, ZrC, NbC, MoC, WC, TaC, or VC. Further, during this HPHT process the other metal also infiltrates into the diamond body, and as the Ti, Zr, Nb, Mo, W, Ta, or V is reacted/depleted, the Cu, Ag, Au, Pd, or Pt infiltrates deeper into the diamond body and becomes the primary component within the interstitial regions of the diamond body in the treated region.

While at the same pressure, the HPHT device is operated to impose an elevated temperature of approximately 1,450° C. for a period of approximately 5 minutes. During this time the other infiltrant material, cobalt, in the substrate melts and infiltrates into the second region of the diamond body to fill the empty voids and pores existing therein, and provides a desired attachment bond between the substrate and the diamond body.

The so-formed diamond construction has a diamond body with a thermally diamond region of approximately 0.055 mm thick having a microstructure characterized by a polycrystalline diamond matrix first phase and a metal carbide and/or inert metal second phase occupying a major population of the empty voids. The total diamond body thickness may be approximately 2.5 mm, and the second region may have a thickness of approximately 1.95 mm. The diamond body's second region was substantially free of the catalyst material used to initially form the PCD body and was attached to the WC—Co substrate, which substrate had a thickness of approximately 13 mm. Further, these thicknesses are representative of a single example construction, and the scope of the present disclosure is not so limited. Rather, other diamond table thicknesses, as well other thermally stable region thicknesses, may be used as described above.

Such diamond constructions may display properties of improved fracture toughness, strength and impact resistance when compared to conventional thermally stable PCD that has been rendered such by removing the catalyst material used to sinter the diamond body either fully or partially therefrom, and that has a material microstructure comprising a resulting plurality of empty pores or voids. In an example embodiment where such diamond construction is configured in the form of a cutting element having a diameter of approximately 13 mm, such diamond construction displayed improved wear resistance, as measured by mill score length, of at least 300 percent when compared to an identically sized cutting element formed from conventional PCD construction, and approximately at least 50 percent when compared to a conventional TSP construction containing the plurality of empty voids resulting from the removal of the catalyst material.

A feature of diamond constructions of this disclosure is that they include a diamond body having a first region that includes, in its interstitial regions which are substantially free of the catalyst material used to form the body, a gradient structure of a metal carbide and an inert metal. The diamond body also possesses a further second region that either comprises PCD (having the catalyst material therein) or a bonded-together diamond crystals whose interstitial regions are also substantially free of the catalyst material, but which may have another infiltrant material occupying those spaces. The population of interstitial regions within the diamond body may substantially filled, thereby providing a resulting material microstructure having an improved degree of mechanical strength, toughness, and thermal stability. Further, the diamond construction may also optionally include a material layer disposed on at least a portion of the diamond body surface that forms at least a portion of the construction working surface, and that improves the impact strength and fracture toughness of the compact. Still further, diamond constructions of this disclosure include a substrate bonded to the diamond body, thereby enabling constructions of this disclosure to be attached by conventional methods such as brazing, welding or the like to a variety of different tooling, cutting and/or wear devices to greatly expand the types of potential end-use applications.

Diamond constructions of this disclosure may be used in a number of different applications, such as tools for mining, cutting, machining and construction applications, where the combined properties of thermal stability, strength/toughness, impact strength, and wear and abrasion resistance are highly desired. Diamond constructions of this disclosure are particularly well suited for use as working, wear and/or cutting components in machine tools for lathing and or milling, and drill and mining bits, such as roller cone rock bits, percussion or hammer bits, diamond bits, and shear cutters used for drilling subterranean formations.

Figure 10:
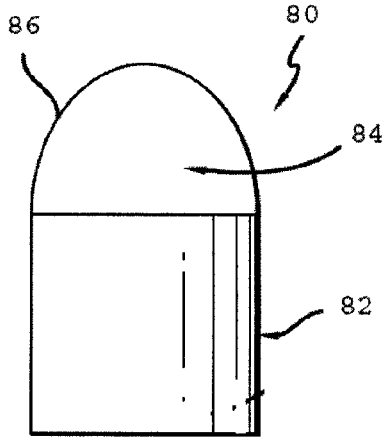
FIG. 10 is a perspective side view of an insert, for use in a roller cone or a hammer drill bit, comprising the diamond constructions of this invention.

FIG. 10 illustrates an embodiment of a diamond construction of this disclosure provided in the form of an insert 80 used in a wear or cutting application in a roller cone drill bit or percussion or hammer drill bit. For example, such inserts 80 may be formed from blanks comprising a substrate portion 82 formed from one or more of the substrate materials disclosed above, and a diamond body 84 having a working surface 86 formed from the thermally stable region of the diamond body. The blanks are pressed or machined to the desired shape of a roller cone rock bit insert.

Figure 11:
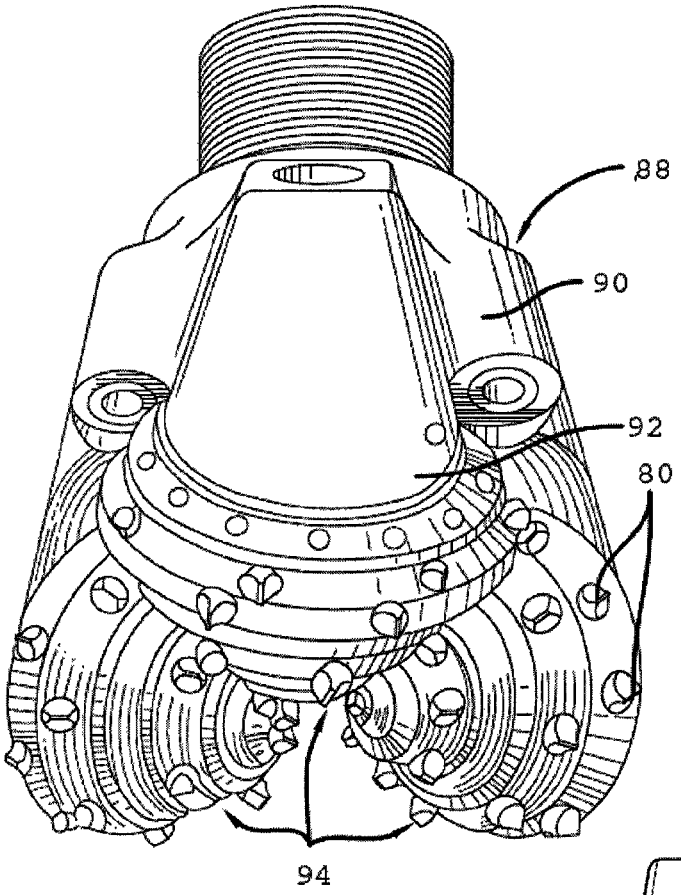
FIG. 11 is a perspective side view of a roller cone drill bit comprising a number of the inserts of FIG. 10.

FIG. 11 illustrates a rotary or roller cone drill bit in the form of a rock bit 88 comprising a number of the wear or cutting inserts 80 disclosed above and illustrated in FIG. 10. The rock bit 88 comprises a body 90 having three legs 92, and a roller cutter cone 94 mounted on a lower end of each leg. The inserts 80 may be fabricated according to the method described above. The inserts 80 are provided in the surfaces of each cutter cone 94 for bearing on a rock formation being drilled.

Figure 12:
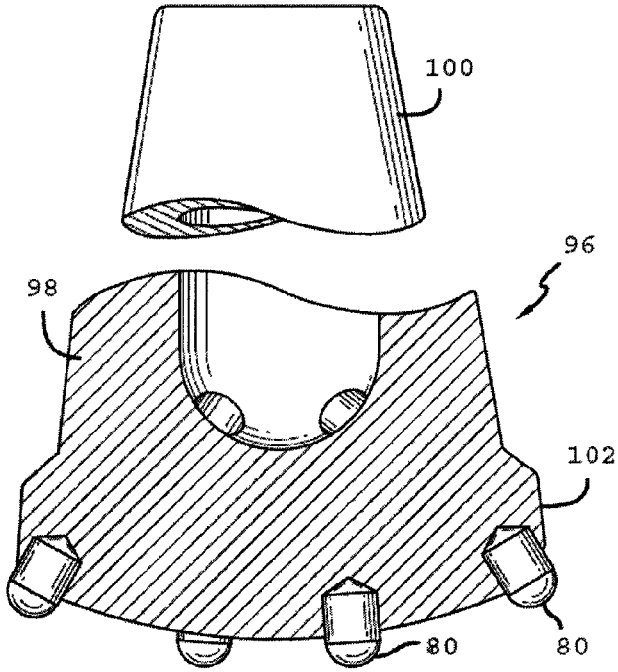
FIG. 12 is a perspective side view of a percussion or hammer bit comprising a number of inserts of FIG. 10.

FIG. 12 illustrates the inserts 80 described above as used with a percussion or hammer bit 96. The hammer bit comprises a hollow steel body 98 having a threaded pin 100 on an end of the body for assembling the bit onto a drill string (not shown) for drilling oil wells and the like. A plurality of the inserts 80 is provided in the surface of a head 102 of the body 98 for bearing on the subterranean formation being drilled.

Figure 13:
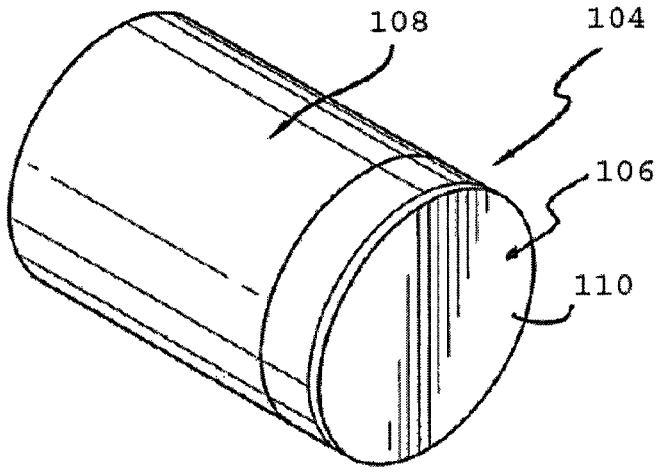
FIG. 13 is a schematic perspective side view of a diamond shear cutter comprising the diamond constructions of this invention.

FIG. 13 illustrates a diamond construction of this disclosure as embodied in the form of a shear cutter 104 used, for example, with a drag bit for drilling subterranean formations. The shear cutter 104 comprises a diamond body 106 that is sintered or otherwise attached to a cutter substrate 108. The diamond body 106 includes a working or cutting surface 110 that includes the material layer that is disposed on a surface of the diamond body.

Figure 14:
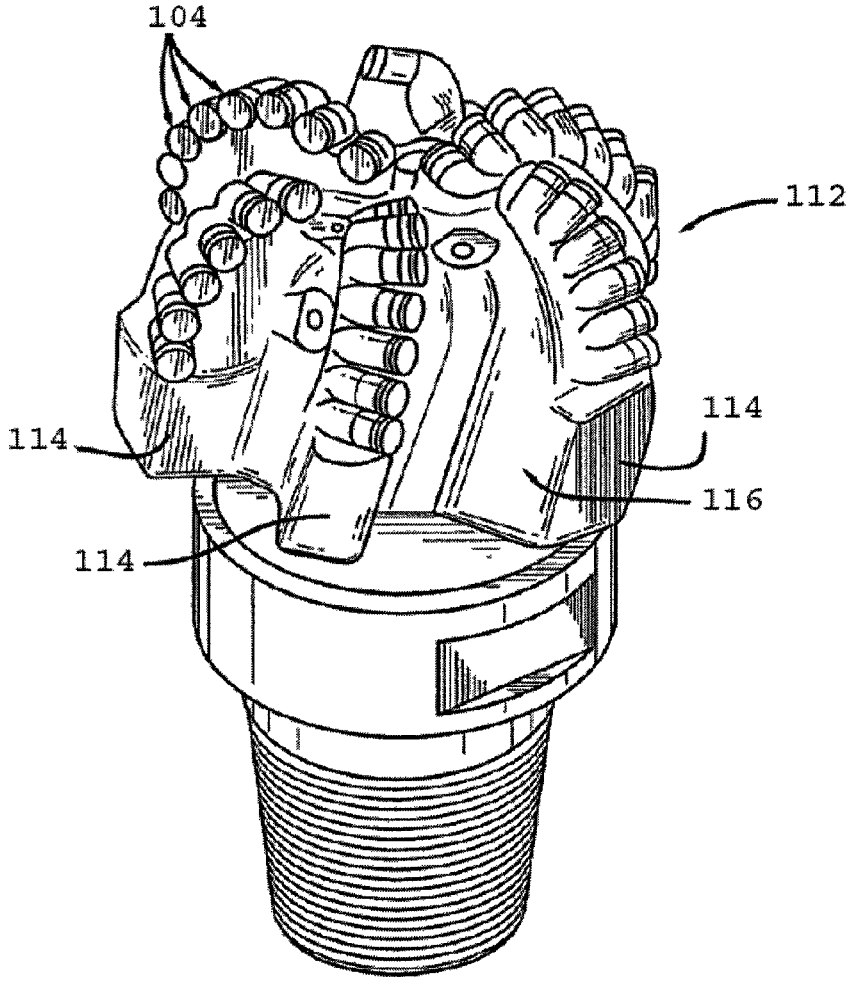
FIG. 14 is a perspective side view of a drag bit comprising a number of the shear cutters of FIG. 13.

FIG. 14 illustrates a drag bit 112 comprising a plurality of the shear cutters 104 described above and illustrated in FIG. 13. The shear cutters are each attached to blades 114 that extend from a head 116 of the drag bit for cutting against the subterranean formation being drilled.

Embodiments of the present disclosure may provide at least one of the following advantages. Such diamond constructions may display properties of improved fracture toughness, strength and impact resistance when compared to conventional thermally stable PCD that has been rendered such by removing the catalyst material used to sinter the diamond body either fully or partially therefrom, and that has a material microstructure comprising a resulting plurality of empty pores or voids. In an example embodiment where such diamond construction is configured in the form of a cutting element having a diameter of approximately 13 mm, such diamond construction displayed improved wear resistance, as measured by mill score length, of at least 300 percent when compared to an identically sized cutting element formed from conventional PCD construction, and approximately at least 50 percent when compared to a conventional TSP construction containing the plurality of empty voids resulting from the removal of the catalyst material.

A feature of diamond constructions of this disclosure is that they include a diamond body having a first region that includes, in its interstitial regions which are substantially free of the catalyst material used to form the body, a gradient structure of a metal carbide and an inert metal. The diamond body also possesses a further second region that either comprises PCD (having the catalyst material therein) or a bonded-together diamond crystals whose interstitial regions are also substantially free of the catalyst material, but which may have another infiltrant material occupying those spaces. The population of interstitial regions within the diamond body may substantially filled, thereby providing a resulting material microstructure having an improved degree of mechanical strength, toughness, and thermal stability. Further, the diamond construction may also optionally include a material layer disposed on at least a portion of the diamond body surface that forms at least a portion of the construction working surface, and that improves the impact strength and fracture toughness of the compact. Still further, diamond constructions of this disclosure include a substrate bonded to the diamond body, thereby enabling constructions of this disclosure to be attached by conventional methods such as brazing, welding or the like to a variety of different tooling, cutting and/or wear devices to greatly expand the types of potential end-use applications.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A diamond construction, comprising:

a diamond body comprising a plurality of bonded-together diamond crystals forming a matrix phase, and a plurality of interstitial regions disposed between the bonded-together diamond crystals, the diamond body comprising:

a first diamond region extending a depth from a surface of the diamond body being substantially free of a catalyst material used to form the diamond body, wherein the first diamond region comprises the matrix phase and in at least a portion of the plurality of interstitial spaces, the first diamond region comprises a metal carbide and an inert metal, wherein the metal carbide is fondled as a result of reaction between the diamond crystals in the matrix phase and a carbide-forming metal; and a second diamond region adjacent the first diamond region comprising the matrix phase and a Group VIII metal in the interstitial regions;

wherein the interstitial regions in the first diamond region comprises a continuously decreasing gradient of the metal carbide and a continuously increasing gradient of the inert metal from the interstitial regions adjacent the surface to the interstitial regions adjacent the second diamond region, such that the interstitial regions adjacent the surface of the diamond body comprises a greater relative amount of the metal carbide and lower relative amount of the inert metal as compared to the interstitial regions in the first diamond region that are adjacent the second diamond region.

2. The construction of claim 1, wherein the interstitial regions adjacent the surface comprise a mixture of the metal carbide and the inert metal.

3. The construction of claim 2, wherein the metal carbide at least partially lines the boundary of the interstitial regions adjacent the diamond crystals and the inert metal is present at least in a core region of the interstitial regions.

4. The construction of claim 1, wherein the interstitial regions adjacent the second diamond region comprise substantially no metal carbide therein.

5. The construction of claim 1, wherein the alloy comprising the inert metal and the carbide-forming metal have a melting temperature that is below the melting temperature of the Group VIII metal in the second diamond region.

6. The construction of claim 1, wherein the second diamond region is substantially free of the catalyst material.

7. The construction of claim 1, wherein the Group VIII metal in the second diamond region is the catalyst material.

8. The construction of claim 1, wherein the carbide-forming metal is selected to form the metal carbide at high pressure/high temperature conditions.

9. The construction of claim 1, further comprising a material layer that is disposed over at least a portion of a surface of the first diamond region, the material layer being formed from the metal carbide.

10. The construction of claim 9, wherein the material layer is substantially free of diamond crystals.

11. The construction of claim 1, further comprising:

a metallic substrate attached to the diamond body, the substrate being attached to the second diamond region.

12. The construction of claim 1 wherein the diamond body has a diamond volume content at one location that is different from a diamond volume content at another location.

13. The construction of claim 1, wherein the first region extends a partial depth into the diamond body from at least a portion of the upper surface of the diamond body.

14. The construction of claim 1, wherein the first region extends a partial depth into the diamond body along the entire upper surface of the diamond body.

15. The construction of claim 13, wherein the first region extends a partial depth into the diamond body from a portion of the side surface of the diamond body.

16. The construction of claim 14, wherein the first region extends a partial depth into the diamond body from a portion of the side surface of the diamond body.

17. The construction of claim 1, wherein the carbide-forming metal is selected from at least one of Ti, Zr, Nb, Mo, W, Ta, V, Si, Cr, B, or Hf.

18. The construction of claim 1, wherein the inert metal is selected from at least one of Cu, Ag, Au, Pd, or Pt.

19. A drill bit, comprising:

a body; and a plurality of cutting elements attached thereto, wherein at least one of the cutting elements comprise the construction of claim 1.

* * * * *

UNITED STATES PATENT AND TRADEMARK OFFICE

CERTIFICATE OF CORRECTION

PATENT NO. : 8,627,904 B2
APPLICATION NO. : 12/753642
DATED : January 14, 2014
INVENTOR(S) : Georgiy Voronin It is certified that error appears in the above-identified patent and that said Letters Patent is hereby corrected as shown below:

In the Claims

At column 26, claim number 1, line number 25, "carbide is fondled as a result of reaction between the" should read:

-- carbide is formed as a result of reaction between the --.

Signed and Sealed this
Thirteenth Day of May, 2014

Michelle K. Lee

Michelle K. Lee
*Deputy Director of the United States Patent and Trademark Office*